US011858773B2

(12) United States Patent
Mitsui

(10) Patent No.: US 11,858,773 B2
(45) Date of Patent: Jan. 2, 2024

(54) POST-PROCESSING DEVICE, IMAGE FORMING SYSTEM, CONTROLLING METHOD AND NON-TRANSITORY RECORDING MEDIUM

(71) Applicant: KONICA MINOLTA, INC., Tokyo (JP)

(72) Inventor: Yasuomi Mitsui, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 18/060,155

(22) Filed: Nov. 30, 2022

(65) Prior Publication Data

US 2023/0183034 A1 Jun. 15, 2023

(30) Foreign Application Priority Data

Dec. 13, 2021 (JP) ..... 2021-201541

(51) Int. Cl.

| | |
|---|---|
| ***B65H 37/04*** | (2006.01) |
| ***B65H 43/00*** | (2006.01) |
| ***B65H 31/20*** | (2006.01) |
| ***B65H 31/36*** | (2006.01) |

(52) U.S. Cl.

CPC ..... *B65H 37/04* (2013.01); *B65H 31/20* (2013.01); *B65H 31/36* (2013.01); *B65H 43/00* (2013.01); *B65H 2515/40* (2013.01); *B65H 2515/60* (2013.01); *B65H 2515/805* (2013.01); *B65H 2801/06* (2013.01)

(58) Field of Classification Search

CPC ..... B65H 31/20; B65H 31/34; B65H 31/36; B65H 43/00; B65H 37/04; B65H 2511/10; B65H 2511/13; B65H 2513/50; B65H 2515/12; B65H 2515/40; B65H 2515/805

USPC ..... 270/58.07, 58.08, 58.09, 58.11, 58.12, 270/58.17

See application file for complete search history.

(56) References Cited

U.S. PATENT DOCUMENTS

| | | | | |
|---|---|---|---|---|
| 7,758,032 | B2 * | 7/2010 | Kawata | B65H 45/30 270/32 |
| 8,226,309 | B2 * | 7/2012 | Funatsu | B65H 1/08 400/624 |
| 8,328,192 | B2 * | 12/2012 | Yamazaki | B65H 7/02 271/262 |
| 8,752,828 | B2 * | 6/2014 | Nakamura | G03G 15/5029 271/265.01 |

(Continued)

FOREIGN PATENT DOCUMENTS

| | | | |
|---|---|---|---|
| JP | 2004085982 | A | 3/2004 |
| JP | 2013095533 | A | 5/2013 |

*Primary Examiner* — Leslie A Nicholson, III
(74) *Attorney, Agent, or Firm* — BUCHANAN INGERSOLL & ROONEY PC

(57) ABSTRACT

A post-processing device, includes a tray that accepts a carried sheet and places thereon; a post-processing unit that performs a post-processing to the sheet placed on the tray; and a controller that controls an operation of the post-processing unit. The controller that: obtains both of: a first sheet type specified by a user; and a second sheet type detected by a media detector that is installed on a sheet carrying path; and controls the operation of the post-processing unit based on the second sheet type when the first sheet type and the second sheet type are different.

23 Claims, 17 Drawing Sheets

(56) References Cited

U.S. PATENT DOCUMENTS

| | | | | |
|---|---|---|---|---|
| 8,955,834 | B1 * | 2/2015 | Imaizumi | B65H 7/20 271/265.01 |
| 9,227,806 | B2 * | 1/2016 | Chiba | B65H 7/02 |
| 9,927,753 | B2 * | 3/2018 | Takahashi | G03G 15/6552 |
| 10,155,635 | B2 * | 12/2018 | Suzuki | B65H 7/14 |
| 10,435,264 | B2 * | 10/2019 | Nishiyama | B41J 11/0095 |
| 10,599,083 | B2 * | 3/2020 | Yoshida | G03G 15/5062 |
| 10,759,619 | B2 * | 9/2020 | Sugiura | G03G 15/6594 |
| 11,591,174 | B2 * | 2/2023 | Izumiya | G03G 15/5029 |
| 2012/0025454 | A1 * | 2/2012 | Iguchi | B65H 29/62 271/265.01 |
| 2020/0148498 | A1 * | 5/2020 | Ishida | B65H 37/04 |
| 2020/0379688 | A1 * | 12/2020 | Sugiura | G06F 3/1203 |

* cited by examiner

FIG. 9

SHEET INFORMATION 69

| PAPER FEEDING TRAY | SHEET TYPE |
|---|---|
| TRAY 1 | REGULAR PAPER |
| TRAY 2 | REGULAR PAPER |
| TRAY 3 | THIN PAPER |

FIG. 11

PADDLE DOWNWARD QUANTITY INFORMATION 76a

| SHEET TYPE | | THIN PAPER | RECYCLED PAPER | REGULAR PAPER | | | THICK PAPER 1 | THICK PAPER 2 | THICK PAPER 3 | THICK PAPER 4 |
|---|---|---|---|---|---|---|---|---|---|---|
| | BASIS WEIGHT ($g/m^2$) | ～40 | 41～60 | 61～70 | 71～80 | 81～90 | 91～120 | 121～160 | 161～220 | 221～ |
| LOADED NUMBER (SHEET) | 1～5 | 25 | 24 | 24 | 23 | 23 | 22 | 22 | 22 | 21 |
| | 6～10 | 25 | 24 | 24 | 23 | 22 | 21 | 21 | 21 | 20 |
| | 11～15 | 25 | 24 | 23 | 22 | 22 | 20 | 20 | 20 | 19 |
| | 16～20 | 25 | 23 | 23 | 22 | 21 | 20 | 19 | 19 | 18 |
| | 21～25 | 24 | 23 | 22 | 21 | 21 | 19 | 18 | 18 | 17 |
| | 26～30 | 24 | 23 | 22 | 21 | 20 | 18 | 18 | 17 | 16 |
| | 31～35 | 24 | 22 | 21 | 20 | 20 | 18 | 17 | 16 | 15 |
| | 36～40 | 24 | 22 | 21 | 20 | 19 | 17 | 16 | 15 | 14 |
| | 41～45 | 23 | 22 | 21 | 19 | 19 | 17 | 16 | 14 | 13 |
| | 46～50 | 23 | 21 | 20 | 19 | 18 | 16 | 15 | 13 | 12 |
| | ⋮ | ⋮ | ⋮ | ⋮ | ⋮ | ⋮ | ⋮ | ⋮ | ⋮ | ⋮ |

PADDLE DOWNWARD QUANTITY (mm)

FIG. 12

NUMBER OF PADDLE ROTATIONS INFORMATION 76b

| SHEET TYPE | THIN PAPER | RECYCLED PAPER | REGULAR PAPER | | | THICK PAPER 1 | THICK PAPER 2 | THICK PAPER 3 | THICK PAPER 4 |
|---|---|---|---|---|---|---|---|---|---|
| BASIS WEIGHT ($g/m^2$) | ～40 | 41～60 | 61～70 | 71～80 | 81～90 | 91～120 | 121～160 | 161～220 | 221～ |
| NUMBER OF ROTATIONS | 2 | 2 | 2 | 2 | 2 | 3 | 3 | 3 | 3 |
| SHEET INTERVAL | MAINTAIN | MAINTAIN | MAINTAIN | MAINTAIN | MAINTAIN | ENLARGE | ENLARGE | ENLARGE | ENLARGE |

FIG. 13

CONTROL QUANTITY ADJUSTMENT INFORMATION 76c

| | IMAGE DENSITY | | TEMPERATURE | | HUMIDITY | |
|---|---|---|---|---|---|---|
| | HIGH | LOW | HIGH | LOW | HIGH | LOW |
| PADDLE DOWNWARD QUANTITY | DECREASE ADJUSTMENT | NO ADJUSTMENT | DECREASE ADJUSTMENT | NO ADJUSTMENT | DECREASE ADJUSTMENT | NO ADJUSTMENT |
| ROTATION NUMBER OF PADDLE | INCREASE ADJUSTMENT | NO ADJUSTMENT | INCREASE ADJUSTMENT | NO ADJUSTMENT | INCREASE ADJUSTMENT | NO ADJUSTMENT |

FIG. 14A

NUMBER OF DRIVES OF ALIGNING PLATE INFORMATION 76d

| SHEET TYPE | THIN PAPER | RECYCLED PAPER | REGULAR PAPER | | | THICK PAPER 1 | THICK PAPER 2 | THICK PAPER 3 | THICK PAPER 4 |
|---|---|---|---|---|---|---|---|---|---|
| BASIS WEIGHT (g/m$^2$) | ~40 | 41~60 | 61~70 | 71~80 | 81~90 | 91~120 | 121~160 | 161~220 | 221~ |
| NUMBER OF DRIVES | 2 | 2 | 1 | 1 | 1 | 1 | 1 | 1 | 1 |

FIG. 14B

STAPLER CONTROL INFORMATION 76e

| SHEET TYPE | THIN PAPER | RECYCLED PAPER | REGULAR PAPER | | | THICK PAPER 1 | THICK PAPER 2 | THICK PAPER 3 | THICK PAPER 4 |
|---|---|---|---|---|---|---|---|---|---|
| BASIS WEIGHT (g/m$^2$) | ~40 | 41~60 | 61~70 | 71~80 | 81~90 | 91~120 | 121~160 | 161~220 | 221~ |
| STAPLER DRIVING VOLTAGE | HIGH VALUE | HIGH VALUE | USUAL VALUE | USUAL VALUE | USUAL VALUE | HIGH VALUE | HIGH VALUE | HIGH VALUE | HIGH VALUE |

POST-PROCESSING DEVICE, IMAGE FORMING SYSTEM, CONTROLLING METHOD AND NON-TRANSITORY RECORDING MEDIUM

Japanese patent application No. 2021-201541 filed on Dec. 13, 2021 including description, claims, drawings, and abstract the entire disclosure is incorporated herein by reference in its entirety.

BACKGROUND

Technological Field

The present invention relates to a post-processing device, an image forming system, a controlling method and a non-transitory recording medium. The present invention more specifically relates to a technique that performs a post-processing to a sheet.

Description of the Related Art

Some post-processing devices connected to image forming devices are known to have two modes, a first alignment mode and a second alignment mode, as an operation mode for aligning multiple sheets. This known technique is introduced for example in Japanese Patent Application Laid-Open No. JP 2013-95533 A. According to the known technique, the post-processing device refers a sheet type manually set by the user and switches the operation mode when the sheet is placed on a tray of the image forming device, for example. As described above, the post-processing device switches the operation for aligning the multiple sheets according to the sheet type so that the multiple sheets are appropriately aligned.

It is difficult for the user to accurately determine the sheet type. The user sometimes sets the wrong sheet type when he or she sets the sheet type by manual. In this case, the sheet type set by the user and the sheet type actually stored in the tray may not match.

When the sheets in the tray are less for the use in the image forming device, the user may restock the sheets in the tray even still the sheets are not run out. The user sometimes restocks the sheets different type from the sheets existing in the tray. In this case, the different types of the sheets may exist in the same tray. Even in this case, the sheet type set in advance by the user and the sheet type stored in the tray may not match.

The sheet type set by the user may not match the sheet type actually delivered to the image forming device. In this case, even still the post-processing device performs an alignment operation to align the multiple sheets based on the sheet type set by the user, the sheets are not appropriately aligned, and there will be a failure of alignment. Thus, the post-processing device cannot perform a post-processing such as stapling by a stapler.

SUMMARY

The present invention is intended to solve the above problems. Thus, the present invention is intended to provide a post-processing device, an image forming system, a controlling method and a non-transitory recording medium that perform a post-processing appropriately depending on a sheet type.

First, the present invention is directed to a post-processing device.

To achieve at least one of the abovementioned objects, according to an aspect of the present invention, the post-processing device reflecting one aspect of the present invention comprises: a tray that accepts a carried sheet and places thereon; a post-processing unit that performs a post-processing to the sheet placed on the tray; and a controller that controls an operation of the post-processing unit. The controller that: obtains both of: a first sheet type specified by a user; and a second sheet type detected by a media detector that is installed on a sheet carrying path; and controls the operation of the post-processing unit based on the second sheet type when the first sheet type and the second sheet type are different.

Second, the present invention is directed to a post-processing device.

To achieve at least one of the abovementioned objects, according to an aspect of the present invention, the post-processing device reflecting one aspect of the present invention comprises: a tray that accepts a carried sheet and places thereon; a post-processing unit that performs a post-processing to the sheet placed on the tray; and a controller that controls an operation of the post-processing unit. The controller that: obtains both of: a first sheet type specified by a user; and a second sheet type detected by a media detector that is installed on a sheet carrying path; and controls the operation of the post-processing unit based on the second sheet type when the second sheet type is detected more in detail than the first sheet type.

Third, the present invention is directed to an image forming system.

To achieve at least one of the abovementioned objects, according to an aspect of the present invention, the image forming system reflecting one aspect of the present invention comprises: a post-processing device according to claim 1; and an image forming device that: forms an image on a sheet; and supplies the sheet on which the image is formed to the post-processing device.

Forth, the present invention is directed to a controlling method applied in a post-processing device to control an operation of a post-processing unit. The post-processing device comprises: a tray that accepts a carried sheet and places thereon; and the post-processing unit that performs a post-processing to the sheet placed on the tray.

To achieve at least one of the abovementioned objects, according to an aspect of the present invention, the controlling method reflecting one aspect of the present invention comprises: obtaining both of: a first sheet type specified by a user; and a second sheet type detected by a media detector that is installed on a sheet carrying path; and controlling the operation of the post-processing unit based on the second sheet type when the first sheet type and the second sheet type are different.

Fifth, the present invention is directed to a controlling method applied in a post-processing device to control an operation of a post-processing unit. The post-processing device comprises: a tray that accepts a carried sheet and places thereon; and the post-processing unit that performs a post-processing to the sheet placed on the tray.

To achieve at least one of the abovementioned objects, according to an aspect of the present invention, the controlling method reflecting one aspect of the present invention comprises: obtaining both of: a first sheet type specified by a user; and a second sheet type detected by a media detector that is installed on a sheet carrying path; and controlling the operation of the post-processing unit based on the second sheet type when the second sheet type is detected more in detail than the first sheet type.

Sixth, the present invention is directed to a non-transitory recording medium storing a computer readable program to be executed by a hardware processor in a post-processing device that comprises: a tray that accepts a carried sheet and places thereon; and the post-processing unit that performs a post-processing to the sheet placed on the tray.

According to an aspect of the present invention, the non-transitory recording medium stores the computer readable program, execution of the computer readable program by the hardware processor causing the hardware processor in the post-processing device to perform: obtaining both of: a first sheet type specified by a user; and a second sheet type detected by a media detector that is installed on a sheet carrying path; and controlling the operation of the post-processing unit based on the second sheet type when the first sheet type and the second sheet type are different.

Seventh, the present invention is directed to a non-transitory recording medium storing a computer readable program to be executed by a hardware processor in a post-processing device that comprises: a tray that accepts a carried sheet and places thereon; and the post-processing unit that performs a post-processing to the sheet placed on the tray.

According to an aspect of the present invention, the non-transitory recording medium stores the computer readable program, execution of the computer readable program by the hardware processor causing the hardware processor in the post-processing device to perform: the computer readable program causes the hardware processor executing the computer readable program to: obtaining both of: a first sheet type specified by a user; and a second sheet type detected by a media detector that is installed on a sheet carrying path; and controlling the operation of the post-processing unit based on the second sheet type when the second sheet type is detected more in detail than the first sheet type.

BRIEF DESCRIPTION OF THE DRAWING

The advantages and features provided by one or more embodiments of the invention will become more fully understood from the detailed description given herein below and the appended drawings which are given by way of illustration only, and thus are not intended as a definition of the limits of the present invention.

FIG. 9 illustrates an example of sheet information;

FIG. 11 illustrates an example of paddle downward quantity information;

FIG. 12 illustrates an example of the number of paddle rotations information;

FIG. 13 illustrates an example of control quantity adjustment information;

FIGS. 14A and 14B illustrate an example of the number of drives of aligning plate information and stapler control information;

DETAILED DESCRIPTION OF EMBODIMENTS

Hereinafter, one or more embodiments of the present invention will be described with reference to the drawings. However, the scope of the invention is not limited to the disclosed embodiments.

Figure 1:
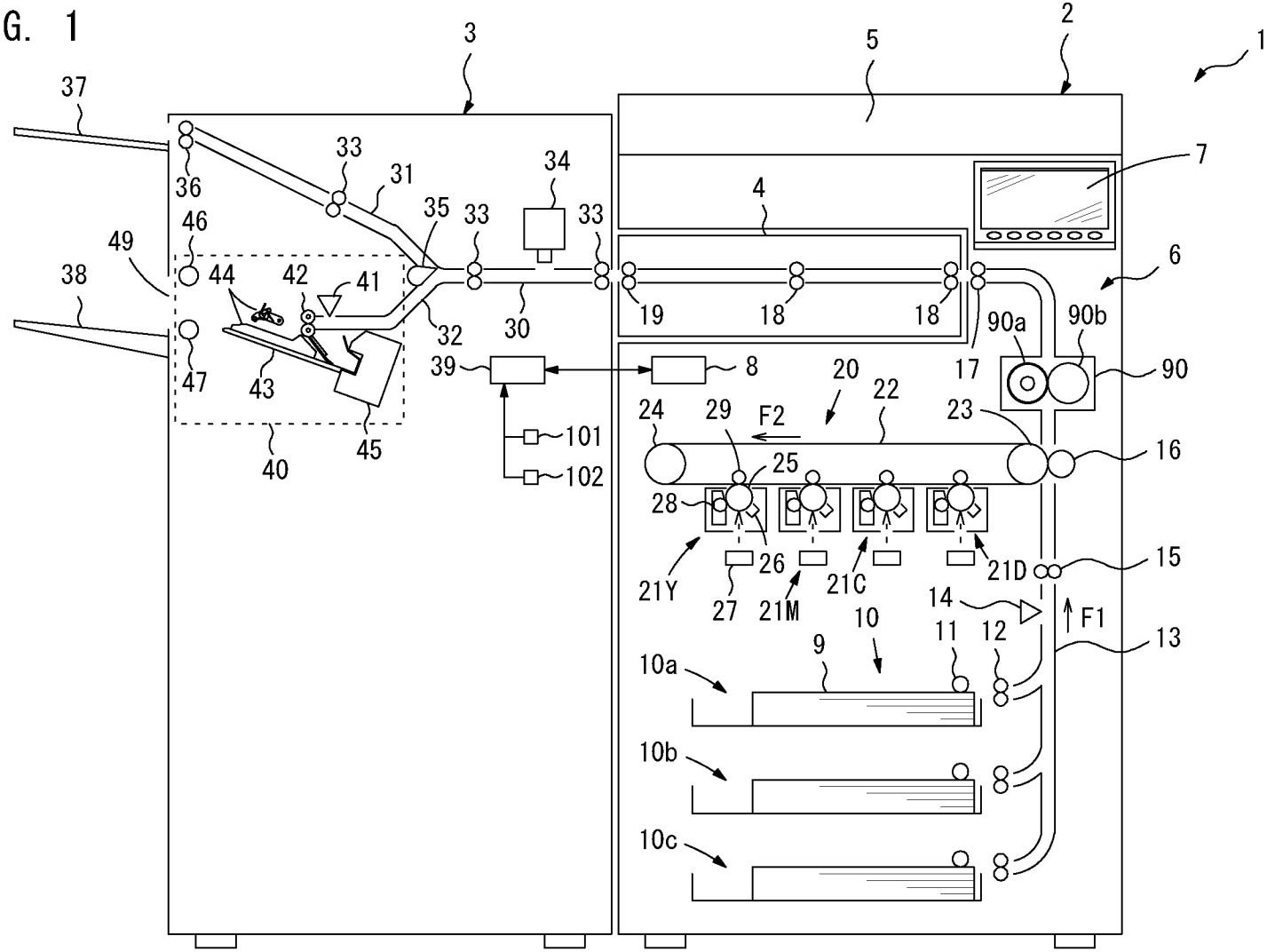
FIG. 1 illustrates an exemplary overall structure of an image forming system.

FIG. 1 illustrates an exemplary overall structure of an image forming system 1 in which the preferred embodiment of the present invention may be practiced. The image forming system 1 includes an image forming device 2 and a post-processing device 3. The image forming system 1 includes a carrying unit 4 that carries the sheet ejected from the image forming device 2 to the post-processing device 3. The carrying unit 4 can be assembled to the image forming device 2.

The image forming device 2 is formed from one of MFPs (Multifunction Peripherals) including a copy function and/or a print function. The image forming device 2 executes a job such as a copy job or a print job. The image forming device 2 has a scanner section 5 in an upper part of the device body and a printer section 6 in a lower part of the device body. The image forming device 2 has an operational panel 7 operable for the user on its front side of the device body. The scanner section 5 optically reads a document placed by a user and outputs image data. The printer section 6 forms an image on a sheet based on the image data to print and outputs. The image forming device 2 includes a controller 8 inside. The controller 8 controls the carrying unit 4, the scanner section 5, the printer section 6 and the operational panel 7, and controls the operation in cooperation with the post-processing device 3.

The printer section 6 includes a paper carrying unit 10, an image forming unit 20 and a fixing unit 90. The paper carrying unit 10 feeds a sheet 9 from one of multiple paper feeding trays 10*a*, 10*b* and 10*c*, and carries the sheet 9 along a carrying path 13 formed inside the printer section 6. The different types of the sheets 9 can be stored in the multiple paper feeding trays 10*a*, 10*b* and 10*c*, or the same type of the sheets 9 can be stored in the multiple paper feeding trays 10*a*, 10*b* and 10*c*. A pickup roller 11 and a paper feeding roller 12 are provided with each paper feeding tray 10*a*, 10*b* and 10*c*. The paper carrying unit 10 drives the pickup roller 11 and the paper feeding roller 12 arranged at one of the multiple paper feeding trays specified by the user, and feeds the sheet 9 toward the carrying path 13. The paper carrying unit 10 carries the sheet 9 sent toward the carrying path 13 along an arrow F1 direction.

There are media detector 14, a timing roller 15, a secondary transfer roller 16, the fixing unit 90 and an ejecting roller 17 arranged on the carrying path 13.

The media detector 14 is a sensor that detects a type of the sheet 9 when the sheet 9 passes through a predetermined position in the carrying path 13. The media detector 14, for instance, formed from a sensor such as an ultrasonic sensor or an optical sensor. The media detector 14 irradiates an ultrasonic signal or an optical signal to the sheet 9 that passes through the predetermined position in the carrying path 13, and detects a signal component reflected by the sheet 9 or a signal component transmits the sheet 9 to detect the basis weight which is the weight per unit area of the sheet 9. Every time the sheet 9 is carried on the carrying path 13, the media detector 14 is capable of detecting the sheet type (the basis weight) of the sheet 9. If the multiple sheets 9 are continuously fed in the image forming device 2, for example, the media detector 14 detects the sheet type when each of the multiple sheets 9 passes through the predetermined position in the carrying path 13.

The timing roller 15 is formed from a pair of rollers. The timing roller 15 adjusts a timing to send out the sheet 9 to a secondary transfer position by the secondary transfer roller 16. The paper carrying unit 10 temporarily stops carrying the sheet 9 when a tip of the sheet 9 fed from the paper feeding trays 10*a*, 10*b* and 10*c* reaches a position of the timing roller 15. The paper carrying unit 10 drives the timing roller 15 at the time when an image primarily transferred to an intermediate transfer belt 22 at the image forming unit 20 is carried to the secondary transfer position, and carries the sheet 9 toward the secondary transfer roller 16.

An image is secondarily transferred to the sheet 9 sent out from the timing roller 15 when it passes the secondary transfer position by the secondary transfer roller 16. The sheet 9 to which the image is secondarily transferred goes toward the fixing unit 90.

The image forming unit 20 includes image forming units 21Y, 21M, 21C and 21K corresponding to each color, Y (yellow), M (magenta), C (cyan) and K (black) and the intermediate transfer belt 22.

The image forming unit 21Y forms an image in a color corresponding to Y. The image forming unit 21Y includes an image carrier 25, an electrifying unit 26, an exposure unit 27 and a developing unit 28. The image carrier 25 has a photosensitive layer on a surface of a cylindrical body, and rotates in a predetermined direction (clockwise direction). The electrifying unit 26, the exposure unit 27 and the developing unit 28 are arranged around the image carrier 25. Predetermined electric charges are charged on a surface of the image carrier 25 by the electrifying unit 26. The exposure unit 27 exposes the surface of the electrified electrifying unit 26 based on the image data to form a latent image on the surface of the image carrier 25. The developing unit 28 supplies toner to the surface of the image carrier 25, and makes the latent image visible with the toner. Thus, an image corresponding to the image data (toner image) is formed on the surface of the image carrier 25. The other image forming units 21M, 21C and 21K have the similar structures as the image forming unit 21Y but supply the different color of the toner to the image carrier 25.

The intermediate transfer belt 22 is an endless belt arranged in an upper side of the image forming units 21Y, 21M, 21C and 21K. The intermediate transfer belt 22 is extended between a driving roller 23 and a driven roller 24. The driving roller 23 is arranged at a position facing the secondary transfer roller 16 and the driven roller 24 is arranged at a position a predetermined interval away from the driving roller 23. As the driving roller 23 is rotated and driven in a counter clockwise direction, the intermediate transfer belt 22 is circulated and moved in an arrow direction F2. The intermediate transfer belt 22 touches the secondary transfer roller 16 at the position of the driving roller 23. Inside the intermediate transfer belt 22, a primary transfer roller 29 is arranged at a position facing each image forming unit 21Y, 21M, 21C and 21K. A specified voltage is applied while the intermediate transfer belt 22 is pushed to the image carrier 25 of each image forming unit 21Y, 21M, 21C and 21K, and the primary transfer roller 29 primarily transfers the image formed on the image carrier 25 (toner image) to the intermediate transfer belt 22. Each image forming unit 21Y, 21M, 21C and 21K lays each image in Y, M, C and K on top of another on the intermediate transfer belt 22 and primarily transfers to form a color image on the surface of the intermediate transfer belt 22. The image transferred on the intermediate transfer belt 22 is secondarily transferred to the sheet 9 at the position of the secondary transfer roller 16.

The fixing unit 90 performs a heating process and a pressure process to the sheet 9 on which the image is formed to fix the image on the sheet 9. The fixing unit 90 includes a heating roller 90*a* and a pressure roller 90*b*, for example. The fixing unit 90 performs the heating process and the pressure process at a nip part between the heating roller 90*a* and the pressure roller 90*b* to fix the image on the sheet 9. The sheet 9 is then delivered to the carrying unit 4 via the ejecting roller 17.

The carrying unit 4 supplies the sheet 9 ejected from the image forming device 2 to the post-processing device 3. A carrying path leading the sheet 9 to the post-processing device 3 from the image forming device 2 is formed in the carrying unit 4, and a carrying roller 18 and an ejecting roller 19 are provided with the carrying path. The sheet 9 ejected from the image forming device 2 is supplied to the post-processing device 3 by the carrying roller 18 and the ejecting roller 19.

The post-processing device 3 performs a post-processing such as stapling to the sheet 9 on which the image is formed in the image forming device 2. The post-processing device 3 is capable of ejecting the sheet 9 without performing the post-processing to the sheet 9.

Carrying paths 30, 31 and 32 carrying the sheet 9 on which the image is formed are formed in the post-processing device 3. The carrying path 30 accepts and carries the sheet 9 ejected from the carrying unit 4. A punch 34 that punches the sheet 9 at a predetermined position is provided with the carrying path 30. For punching the sheet 9 ejected from the image forming device 2, the post-processing device 3 drives the punch 34 when a punching position of the sheet 9 is at the predetermined position, and forms a punch hole on the sheet 9.

The rear end of the carrying path 30 forks into the two carrying paths 31 and 32. In the part that the carrying path forks, a switching member 35 is arranged. The switching member 35 distributes the course of the sheet 9 carried from the upstream side of the carrying path 30 to one of the two carrying paths 31 and 32.

The carrying path 31 is to eject the sheet 9 to a first ejecting tray 37. A carrying roller 33 and an ejecting roller 36 are provided with the carrying path 31. The sheet 9 guided to the carrying path 31 is ejected to the first ejecting tray 37 by the carrying roller 33 and the ejecting roller 36.

The carrying path 32 leads the sheet 9 to a post-processing unit 40, and ejects the sheet 9 to which the post-processing is performed by the post-processing unit 40 to a second ejecting tray 38 from an ejecting port 49. A pair of rollers 46 and 47 are arranged near the ejecting port 49. The roller 46 is arranged in the upper part of the roller 47 and can be moved toward the roller 47. The roller 46 is usually retreated at a position a specified interval separated from the roller 47. The sheet 9 is ejected to the second ejecting tray 38 after the post-processing is performed to the sheet 9 by the post-processing unit 40. In this case, the roller 46 moves toward the roller 47 and rotates while the sheet 9 is sandwiched between the roller 46 and the roller 47 so that the sheet 9 is ejected to the second ejecting tray 38.

The post-processing unit 40 of the present embodiment, for example, includes a stapler 45 that staples the multiple sheets 9. The pair of rollers 46 and 47 eject the bundle of sheets 9 that is stapled by the stapler 45 to the second ejecting tray 38. The second ejecting tray 38 can be slide and moved in a vertical direction along a side surface of the post-processing device 3. As the number of the bundle of sheets placed on the second ejecting tray 38 increases, the second ejecting tray 38 moves to the lower side so that the bundle of sheets that come after can be placed.

For enabling the post-processing unit 40 to perform the post-processing to the sheet 9 sent from the image forming device 2, the post-processing device 3 drives the switching member 35 to switch the course of the sheet 9 to the path leading to the carrying path 32 from the carrying path 30.

A pair of rollers 42 are arranged at the rear end of the carrying path 32 that leads the sheet 9 to the post-processing unit 40. A sheet detector 41 that detects the sheet 9 is arranged at a predetermined position at an upstream side of the pair of rollers 42. The sheet detector 41 is formed from a sensor such as a reflection type optical sensor or an ultrasonic sensor and is capable of detecting the sheet 9 carried along the carrying path 32. The sheet 9 guided by the carrying path 32 is detected by the sheet detector 41 at a position in front of the pair of rollers 42. The sheet 9 is then carried by the pair of rollers 42. The rear end of the sheet 9 is out of the nip part of the pair of rollers 42 so that it is ejected from the carrying path 32 and supplied to the post-processing unit 40.

A tray 43 that can load the multiple sheets 9 is arranged at the lower side of the pair of rollers 42. The tray 43 enables the tip side of the sheet 9 ejected from the pair of rollers 42 to be kept at a high position and the rear side at a low position. To be more specific, the tray 43 is placed which is inclined downwardly toward the rear end side from the tip end side of the sheet 9. The sheet 9 ejected to the post-processing unit 40 is placed on the tray 43.

The sheet 9 that comes after is placed on the tray 43 one after the other.

The post-processing unit 40 includes an aligning unit 44 that aligns the sheet 9 placed on the tray 43. The aligning unit 44 aligns the multiple sheets 9 in the carrying direction of the sheet 9 and the width direction orthogonal to the carrying direction of the sheet 9. The aligning unit 44 aligns the multiple sheets 9 in the carrying direction and the width direction before the post-processing such as stapling is performed by the stapler 45, for example.

The post-processing device 3 includes a controller 39 that controls operations of the carrying roller 33, the punch 34, the ejecting roller 36, the switching member 35, the post-processing unit 40, the rollers 46 and 47 and the second ejecting tray 38. A temperature sensor 101 and a humidity sensor 102 are connected to the controller 39. The controller 39 is capable of controlling operations of each part based on environmental information such as temperature and/or humidity. The temperature sensor 101 and the humidity sensor 102 may be installed in the image forming device 2 instead of the post-processing device 3.

Figure 2:
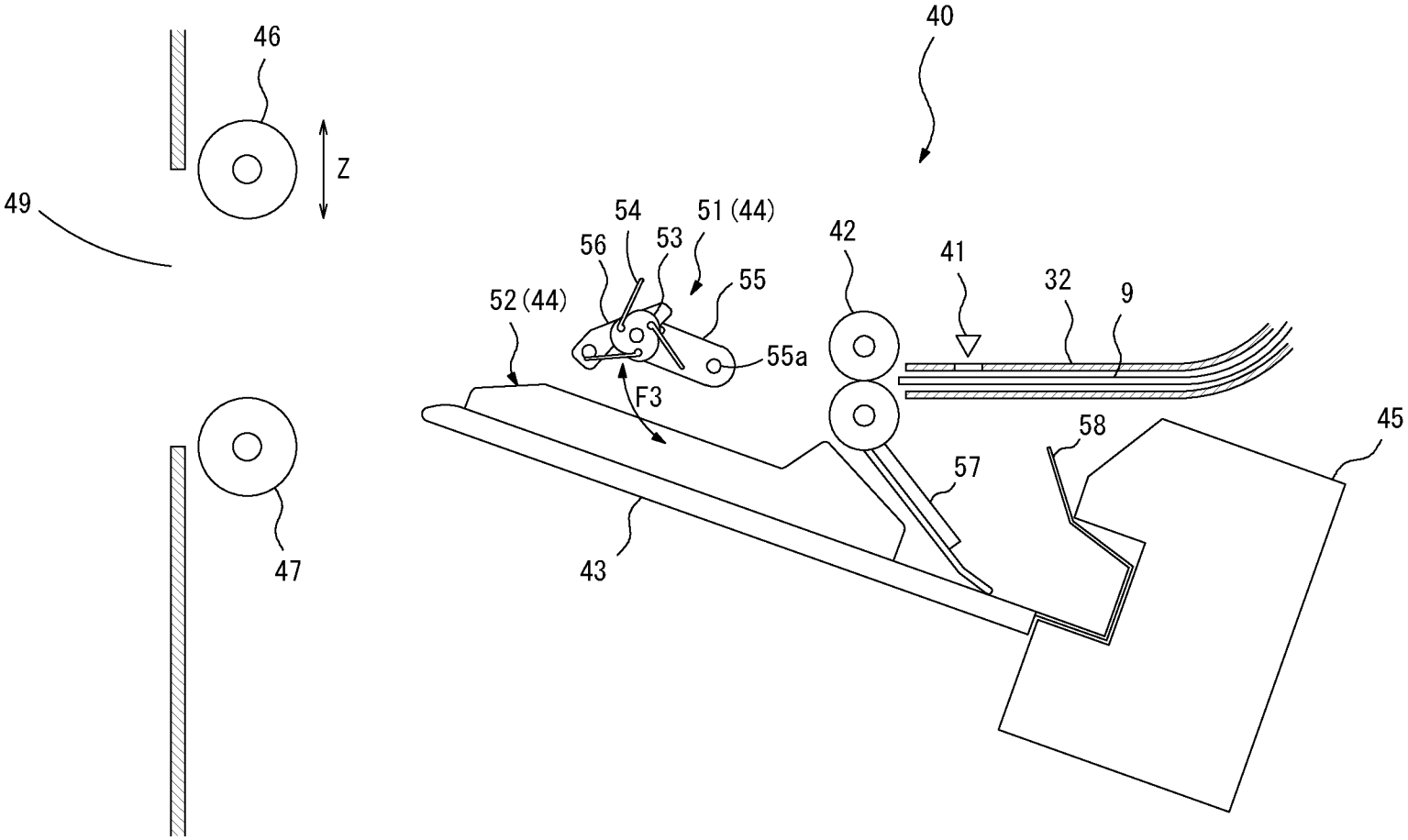
FIG. 2 illustrates a side view of a post-processing unit.
Figure 3:
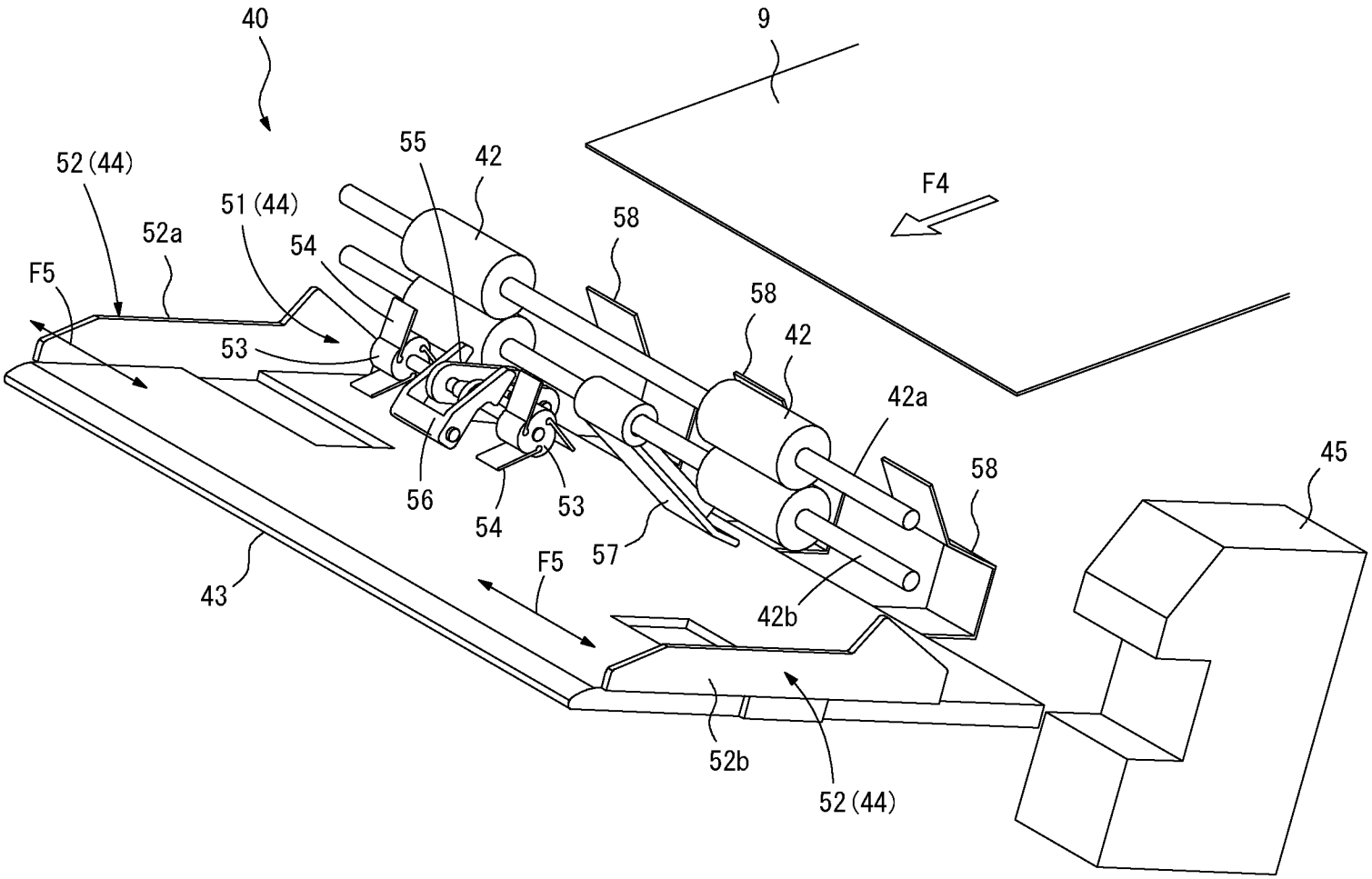
FIG. 3 illustrates a perspective view of the post-processing unit.

FIG. 2 illustrates a side view of the post-processing unit 40. FIG. 3 illustrates a perspective view of the post-processing unit 40. The aligning unit 44 includes a first aligning member 51 and a second aligning member 52. The first aligning member 51 aligns the sheet 9 placed on the tray 43 in the carrying direction of the sheet 9. The second aligning member 52 aligns the sheet 9 in the width direction orthogonal to the carrying direction of the sheet 9. A stopper 58 that restricts the move in the carrying direction of the sheet 9 is arranged on the rear end side of the sheet of the tray 43 inclined downwardly.

The first aligning member 51 makes the rear end of the sheet 9 ejected from the pair of rollers 42 but against the stopper 58 to align the sheet 9 in the carrying direction. The first aligning member 51 includes a swinging arm 55 the base end of which is supported by a swinging shaft 55*a* inside the post-processing device 3, a rotation member 53 that is attached rotatable to the tip of the swinging arm 55, a driving lever 56 that engaged to the tip of the swinging arm 55 and swings the swinging arm 55 around the swinging shaft 55*a* to move the rotation member 53 up and down in a direction shown by an arrow F3 of FIG. 2. The rotation member 53 is formed as a paddle rotation body that includes multiple paddles butted toward outward in a tangent direction of outer peripheral surface. The paddle 54 is, for example, formed from an elastic member that has a flexibility like rubber.

The swinging arm 55 is energized by an energizing member such as a coil spring which is not shown in figures. The tip of the swinging arm 55 is usually placed upper than the ejecting position of the sheet 9 ejected from the pair of rollers 42 as shown in FIG. 2. The paddle 54 of the rotation member 53 is kept at a waiting position upper than the ejecting position of the sheet 9. The sheet 9 is ejected upper than the tray 43 from the pair of rollers 42.

Figure 4:
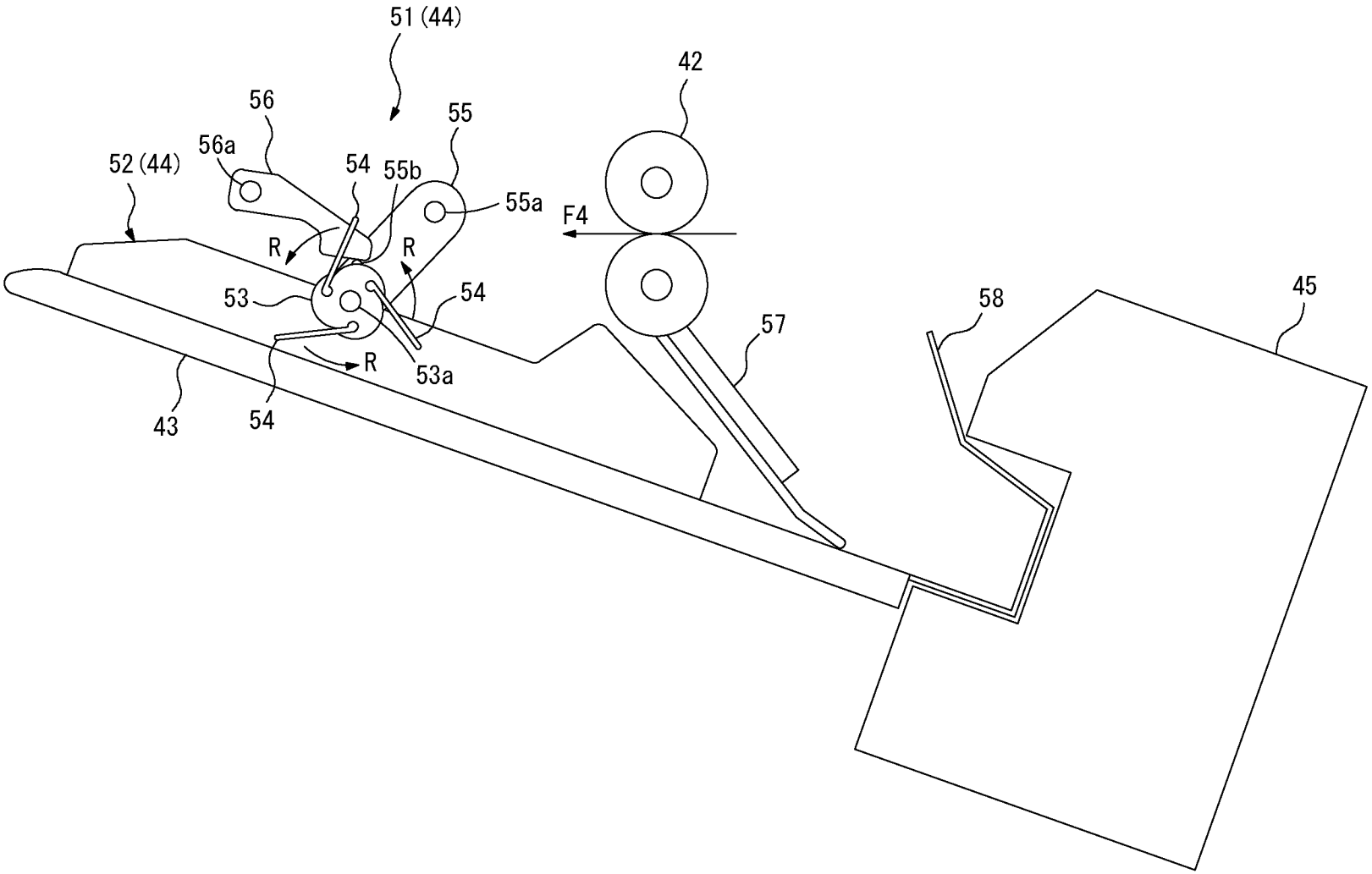
FIG. 4 illustrates an enlarged view illustrating a state where a swinging arm is pushed down.

The driving lever 56 pushes down the swinging arm 55 at a timing just after the sheet 9 is ejected to the upper part of the tray 43. FIG. 4 illustrates an enlarged view illustrating a state where the swinging arm 55 is pushed down. The driving lever 56 is engaged with an engaging projection 55*b* arranged at the tip of the swinging arm 55. The driving lever 56 is allowed to swing around a swinging shaft 56*a* arranged at the base end. The driving lever 56 rotates centered on the swinging shaft 56*a* as against the energizing force of the energizing member upwardly energizes the swinging arm 55, and downwardly pushes the engaging projection 55*b*. The tip of the swinging arm 55 is made descend toward the upper surface of the tray 43 as illustrated in FIG. 4. The paddle 54 of the rotation member 53 is then made descend toward the upper surface of the tray 43. Thus, the sheet 9 ejected from the pair of rollers 42 in an arrow F4 direction is pushed to the upper surface of the tray 43 and made descend by the descend of the paddle 54 of the rotation member 53, then placed on the top surface of the tray 43.

The rotation member 53 is rotatable in a predetermined direction (an arrow R direction of FIG. 4) centered on a rotation shaft 53*a* by a motor which is not illustrated in figures. As the rotation member 53 rotates, the multiple paddles 54 rotate in the predetermined direction. As the rotation member 53 lowers from the waiting position, it rotates centered on the rotation shaft 53*a*. Together with the rotation of the rotation member 53, the paddle 54 rotates in contact with the upper surface of the sheet 9. The sheet 9 placed on the top surface of the tray 43 will receive a carrying force in a direction toward the stopper 58 on the tray 43 from the paddle 54 in response to the rotation of the paddle 54. As a result, the sheet 9 placed on the tray 43 moves toward the position of the stopper 58 due to the carrying force received from the paddle 54. The sheet 9 rests in a condition that the rear end part is in contact with the stopper 58. The first aligning member 51 is allowed to align the rear end part of the multiple sheets 9 placed on the tray 43 to the condition that the rear end part is abutting against the stopper 58. The sheet 9 is then aligned in the carrying direction. The alignment in the carrying direction of the sheet 9 is sometimes called FD alignment.

A pressing member 57 that presses the upper surface of the sheet 9 placed on the upper surface of the tray 43 is arranged between the first aligning member 51 and the stopper 58. The pressing member 57 is loosely inserted into a shaft part 42*b* at the lower side so that it can idle among a shaft part 42*a* and the shaft part 42*b* that support the pair of rollers 42 as illustrated in FIG. 3, for example. The pressing member 57 presses the upper surface of the sheet 9 which is placed on top on the sheets 9 on the tray 43. Even when a curl is generated at the rear end of the sheet 9, for example, the pressing member 57 presses the upper surface of the sheet 9 so that the curl is extended and the rear end of the sheet 9 is butted against the stopper 58.

The second aligning member 52 is arranged at both ends of the tray 43 in the width direction orthogonal to the carrying direction of the sheet 9 (F4 direction) as illustrated in FIG. 3. The second aligning member 52 includes a pair of aligning plates 52*a* and 52*b* butted upward from the upper surface of the tray 43 at both ends of the tray 43. The second aligning member 52 enables each of the pair of aligning plates 52*a* and 52*b* to move forward and backward in the width direction (F5 direction) of the sheet 9 according to the size in the width direction of the sheet 9 to align the both ends in the width direction of the sheet 9 to the predetermined position. The second aligning member 52 may enable to move each of the pair of aligning plates 52*a* and 52*b* by making the moving amount of each of the pair of aligning plates 52*a* and 52*b* equal. The second aligning member 52 may enable to move each of the pair of aligning plates 52*a* and 52*b* by making the moving amount of one of the pair of aligning plates 52*a* and 52*b* be more than another. As described above, the second aligning member 52 presses both ends in the width direction of the sheet 9 with the pair of aligning plates 52*a* and 52*b* so that the sheet 9 is aligned in the width direction. The alignment in the width direction of the sheet 9 is sometimes called CD alignment.

Figure 5:
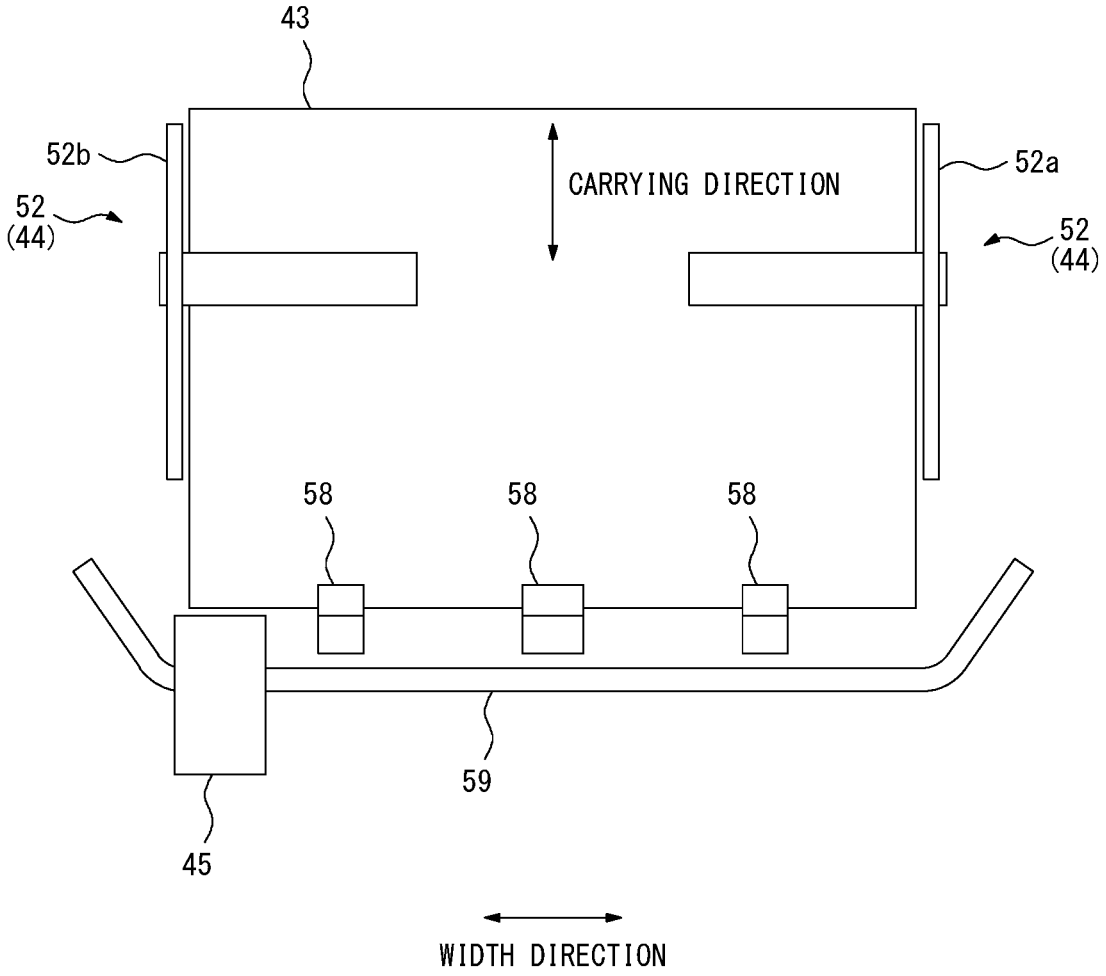
FIG. 5 illustrates a view of a tray from the top.

FIG. 5 illustrates a view of the tray 43 from the top. As illustrated in FIG. 5, the stapler 45 is supported movably along a guiding unit 59 which is a rail shape arranged at the back-end side of the sheet 9 placed on the tray 43. The guiding unit 59 includes a straight-line part parallel to the width direction of the sheet 9 and a curved line part that is folded so as to go around the side surface side of the tray 43 at the both ends part in the width direction of the tray 43. The stapler 45 moves along the aforementioned guiding unit 59, and the binding with needles is performed at any position on the back-end side of the sheet 9. When the position of the needle binding position by the stapler 45 is overlapped to the position of the stopper 58, the needle binding processing cannot be performed if the stopper 58 is not moved. The stopper 58 may be formed to be movable in the width direction of the sheet 9.

Figure 6:
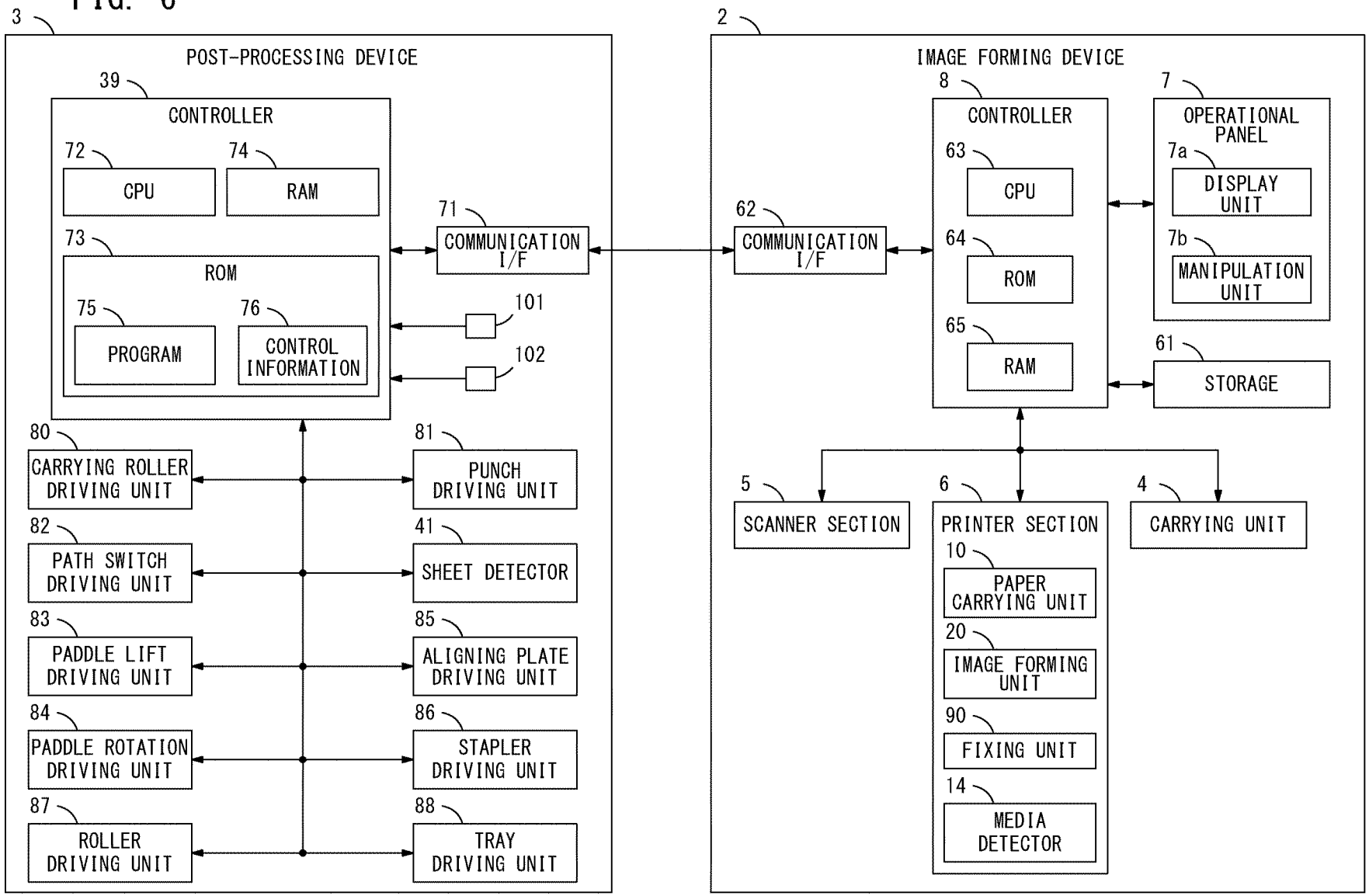
FIG. 6 illustrates a block diagram showing an example of hardware structures of an image forming device and a post-processing device.

Next, a controlling structure of the image forming system 1 is explained. FIG. 6 illustrates a block diagram showing an example of hardware structures of the image forming device 2 and the post-processing device 3.

As illustrated in FIG. 6, the image forming device 2 includes a storage 61 and a communication interface 62 besides the above-described scanner section 5, printer section 6, carrying unit 4, operational panel 7 and controller 8. The communication interface 62 is an interface for the controller 8 to communicate with the controller 39 of the post-processing device 3. The storage 61 is formed from a non-volatility storage device and various kinds of information is stored therein. The operational panel 7 includes a display unit 7*a* that displays screens operable for the user and a manipulation unit 7*b* that receives operations by the user. The controller 8 includes a CPU 63, a ROM 64 and a RAM 65. The CPU 63 executes a program stored in the ROM 64 so that it controls overall operations in the image forming device 2. The ROM 64 is a non-volatility memory in which information such as the program executed by the CPU 63 is stored. The RAM 65 is a volatility memory in which information such as temporal data generated when the CPU 63 executes the program is stored.

As illustrated in FIG. 6, the post-processing device 3 includes a communication interface 71, a carrying roller driving unit 80, a punch driving unit 81, a path switch driving unit 82, a paddle lift driving unit 83, a paddle rotation driving unit 84, an aligning plate driving unit 85, a stapler driving unit 86, a roller driving unit 87 and a tray driving unit 88 besides the aforementioned controller 39, temperature sensor 101, humidity sensor 102 and the sheet detector 41.

The communication interface 71 is for the controller 39 to communicate with the controller 8 of the image forming device 2. The carrying roller driving unit 80 is a driving circuit that drives the carrying roller 33 to carry the sheet 9. The punch driving unit 81 is a driving circuit that drives the punch 34 to punch a punch hole on the sheet 9. The path switch driving unit 82 is a driving circuit that drives the switching member 35 to switch the carrying path of the sheet 9. The paddle lift driving unit 83 is a driving circuit that rotates the driving lever 56 to enable the paddle 54 of the rotation member 53 to move up and down. The paddle rotation driving unit 84 is a driving circuit that rotates the rotation member 53 of the first aligning member 51 to put the paddle 54 to go close to the sheet 9 and applies a carrying force to carry the sheet 9 toward the stopper 58. The aligning plate driving unit 85 is a driving circuit that enables the pair of the aligning plates 52*a* and 52*b* of the second aligning member 52 to move in the width direction of the sheet 9. The stapler driving unit 86 is a driving circuit that moves the stapler 45 to a stapling position, and enables the stapling operation by the stapler 45 to be performed. The stapler driving unit 86, for instance, drives the stapler 45 with driving voltage specified by the controller 39 in the stapling operation. The roller driving unit 87 is a driving circuit that drives the pair of rollers 46 and 47 to eject the sheet 9 on which the post-processing is performed by the post-processing unit 40 to the second ejecting tray 38. The tray driving unit 88 is a driving circuit that slidingly moves the second ejecting tray 38 in a vertical direction.

The controller 39 includes a CPU 72, a ROM 73 and a RAM 74. The CPU 72 is a hardware processor that executes a program 75 stored in the ROM 73 to control overall operations in the post-processing device 3. The ROM 73 is a non-volatility memory in which information such as the program 75 executed by the CPU 72 and/or control information 76 is stored. The detail of the control information 76 is explained later. The RAM 74 is a volatility memory in which information such as temporal data generated when the CPU 72 executes the program is stored.

Figure 7:
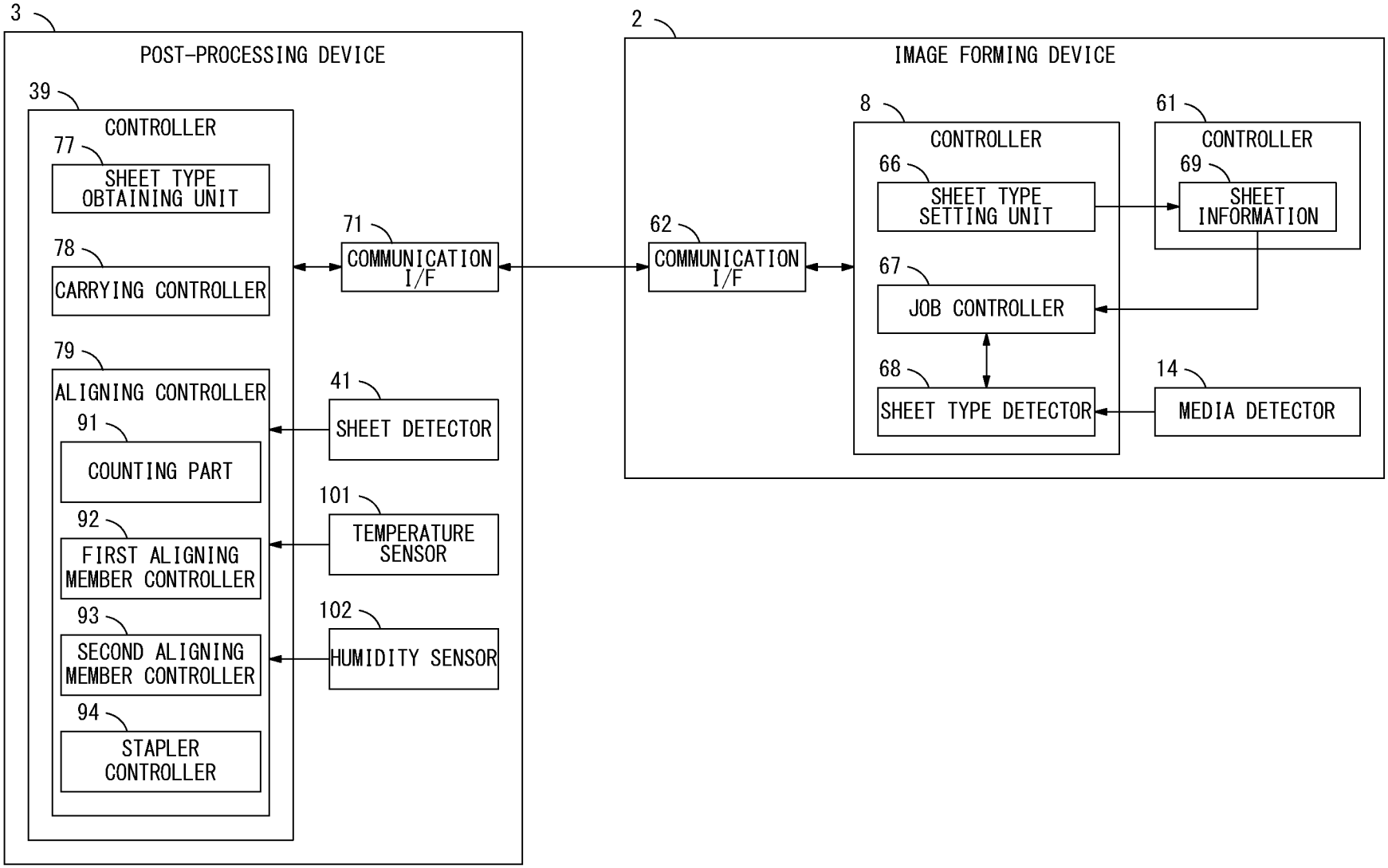
FIG. 7 illustrates a block diagram showing an example of functional structures of the image forming device and the post-processing device.

FIG. 7 illustrates a block diagram showing an example of functional structures of the image forming device 2 and the post-processing device 3. The CPU 63 executes the predetermined program so that the controller 8 of the image forming device 2 serves as a sheet type setting unit 66, a job controller 67 and a sheet type detector 68.

The sheet type setting unit 66 sets the type of the sheet 9 stored in each of the multiple paper feeding trays 10*a*, 10*b* and 10*c*. After the sheet 9 is refilled in any of the paper feeding trays 10*a*, 10*b* and 10*c* by the user, for example, the sheet type setting unit 66 displays a sheet setting screen on the display unit 7*a* of the operational panel 7, and receives a setting operation of the type of the sheet 9 by the user.

Figure 8A:
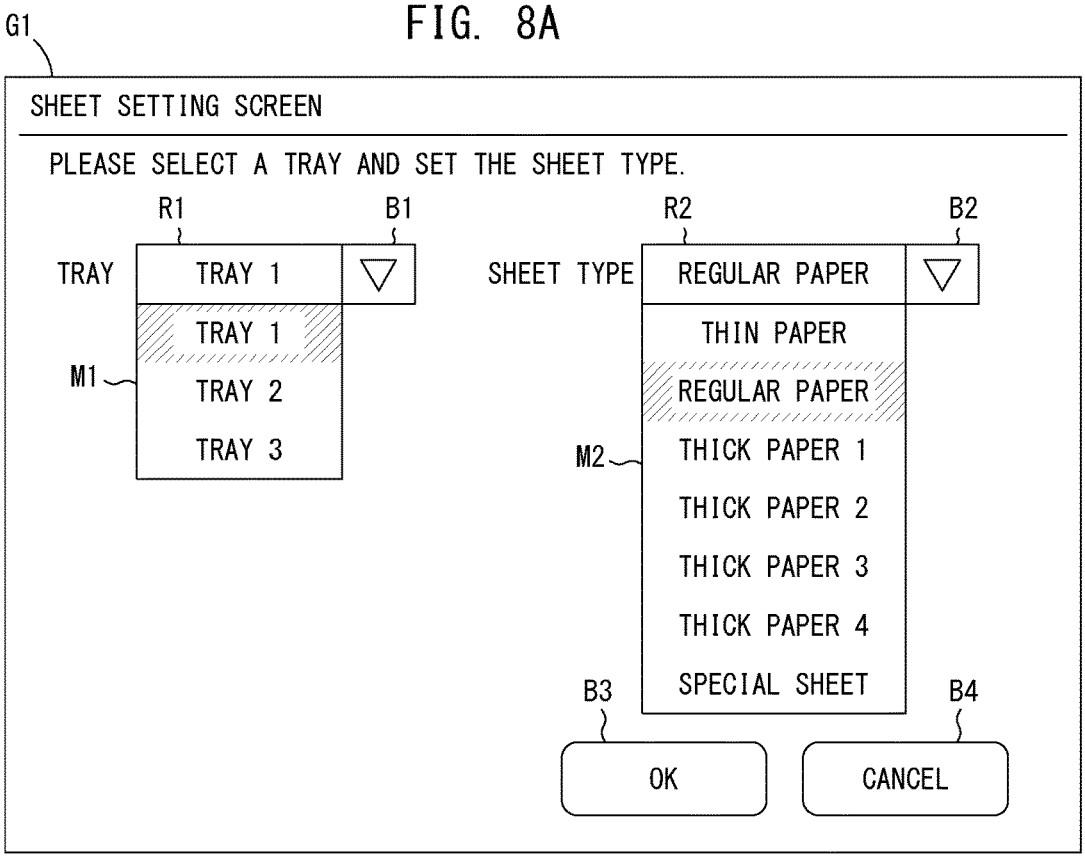
FIGS. 8A and 8B illustrate an example of a sheet setting screen.
Figure 8B:
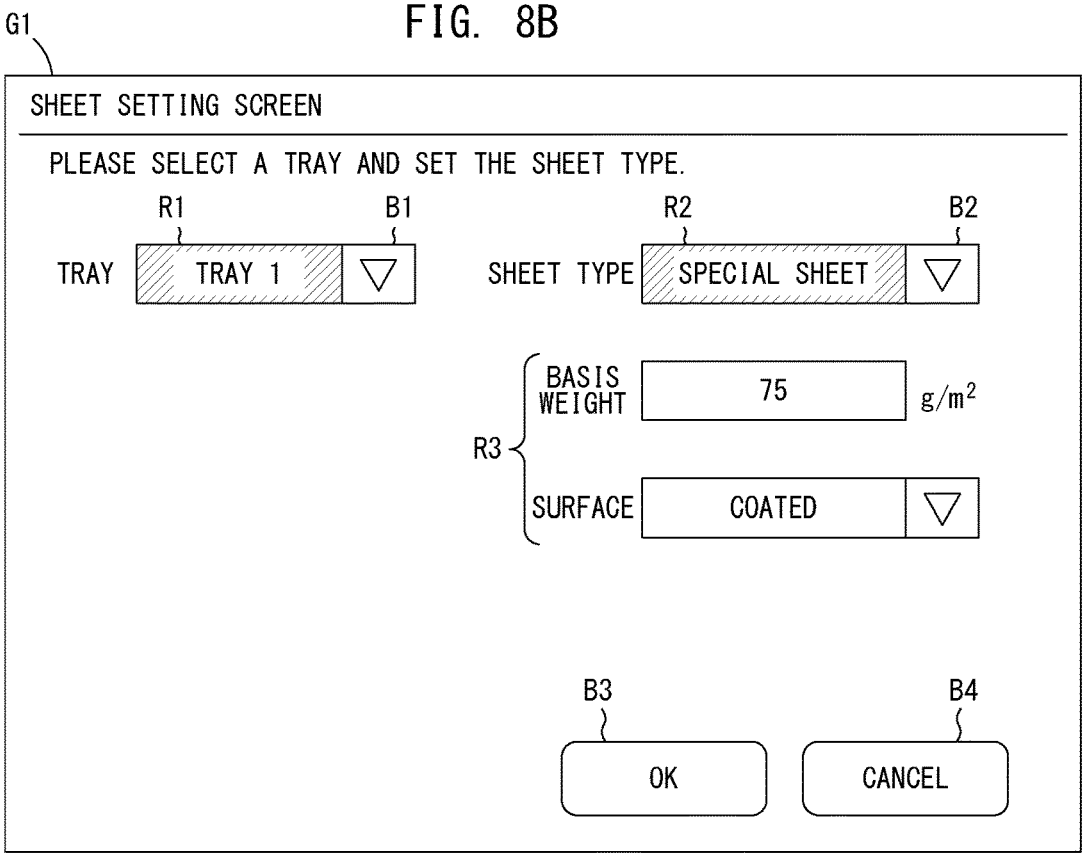

FIGS. 8A and 8B illustrate an example of a sheet setting screen G1. As illustrated in FIG. 8A, for example, a tray display field R1 and a sheet type display field R2 are shown in the sheet setting screen G1. The paper feeding tray 10*a*, 10*b* or 10*c*, the target of the sheet type is shown in the tray display field R1, and the sheet type is shown in the sheet type display field R2. A button B1 to display a pull-down menu M1 is shown in the right side of the tray display field R1. Once the user operates the button B1, the pull-down menu M1 appears in the sheet setting screen G1 as illustrated in FIG. 8A. The user selects one of the trays from the pull-down menu M1, and he or she is allowed to set the paper feeding tray in which the sheet of the sheet type to set is stored. A button B2 to display a pull-down menu M2 is also shown in the right side of the sheet type display field R2. Once the user operates the button B2, the pull-down menu M2 appears in the sheet setting screen G1 as illustrated in FIG. 8A. A list of the multiple sheet types that can be set by the user is shown in the pull-down menu M2. The user selects the sheet type that corresponds to the type of the sheet 9 refilled in the paper feeding tray that is selected as the sheet type to set so that the sheet type is set. There are seven types, for example, that can be set by the user including thin paper, regular paper, thick paper 1, thick paper 2, thick paper 3, thick paper 4 and special sheet. The thin paper, regular paper, thick paper 1, thick paper 2, thick paper 3 and thick paper 4 are the paper that is distinguished by the basis weight. The basis weight of the thin paper is the smallest, and is less than 40 g/m$^2$, for instance. The basis weight of the regular paper is larger than the thin paper but smaller than the thick paper. The basis weight of the regular paper is between 41 to 90 g/m$^2$, for example. Among the thick paper, the basis weight is increased in the order of the thick paper 1 to 4. The basis weight of the thick paper 1 is, for example, between 91 to 120 g/m$^2$, and the basis weight of the thick paper 2 is between 121 to 160 g/m$^2$. The basis weight of the thick paper 3 is between 161 to 220 g/m$^2$, and the basis weight of the thick paper 4 is equal to and more than 221 g/m$^2$. The user selects the type of the sheet 9 refilled in the paper feeding tray from among the thin paper, regular paper, thick paper 1, thick paper 2, thick paper 3 and thick paper 4, so that the basis weight of the sheet 9 can be set. The user then operates an OK button B3 in the sheet setting screen G1 to normally complete the setting operation of the type of the sheet 9. A cancel button B4 is to complete without reflecting the setting operation of the type of the sheet 9.

The user is also enabled to select the special sheet in the sheet setting screen G1. Once the user selects the special sheet, the screen shifts from the sheet setting screen G1 to one illustrated in FIG. 8B. More specifically, a sheet setting field R3 for setting the basis weight and/or a surface condition of the sheet 9 by manual is shown in the sheet setting screen G1. The user is allowed to set the sheet type such as the basis weight and/or the surface condition of the sheet 9 in the sheet setting field R3 in detail. If the user knows the accurate data such as the basis weight of the sheet 9, he or she may select the special sheet. The user then is enabled to accurately set the type of the sheet 9.

After receiving the setting operation of the type of the sheet 9 by the user, the sheet type setting unit 66 stores sheet information 69 in the storage 61. FIG. 9 illustrates an example of the sheet information 69. As illustrated in FIG. 9, each paper feeding tray 10*a*, 10*b* and 10*c* is made correspondent to the type of the stored sheet 9 (the sheet type set by the user) in the sheet information 69. When the sheet type set by the user is the special sheet, information such as the basis weight and/or the surface condition of the sheet 9 specified by the user is described in the field of the sheet type.

The job controller 67 controls the execution of the job in the image forming device 2. The job controller 67 receives the job setting operation by the user and controls the execution of the job with reflecting the setting specified by the user. For the copy job or the print job, for example, the job controller 67 receives the operation to select the paper feeding tray by the user and feeds the sheet 9 from the paper feeding tray selected by the user. The job controller 67 then forms images. In order to do so, the job controller 67 reads the sheet information 69 in the storage 61, identifies the type of the sheet 9 stored in the paper feeding tray selected by the user, and sets a system speed corresponding to the type of the sheet 9 to be fed. The system speed states the carrying speed of the sheet 9. When the type of the sheet 9 is the thick paper, for example, it is necessary for the sheet 9 to pass the fixing unit 90 at lower speed than the regular paper to certainly fix the image to the sheet 9 at the fixing unit 90. Hence, the job controller 67 sets the system speed suitable for the type of the sheet 9 identified based on the sheet information 69, and starts the paper carrying operation of the sheet 9 by driving the paper carrying unit 10. The job controller 67 also drives the image forming unit 20 and the fixing unit 90 adjusting the system speed besides the paper carrying unit 10, and forms the image on the sheet 9. The job controller 67 then ejects the sheet 9 from the image forming device 2. When the job is to continuously feed the sheets 9, the job controller 67 sets the sheet interval based on the type of the sheet 9 at start of the execution of the job. The sheet interval thereby set is an initial interval.

At the start of the execution of the job, the job controller 67 notifies the controller 39 of the post-processing device 3 of detailed information of the job. The system speed is included in the detailed information of the job. Also, information showing whether or not to perform the post-processing including binding with needles every predetermined sheet in the post-processing device 3. Once identifying the type of the sheet 9 based on the sheet information 69, the job controller 67 notifies the post-processing device 3 of the identified sheet type. As a result, the post-processing device 3 is enabled to perform the aligning operation corresponding to the sheet type.

Moreover, after the start of the execution of the job, the job controller 67 notifies the post-processing device 3 of image density of the image as it forms the image on the fed sheet 9. As a result, the post-processing device 3 is enabled to perform the aligning operation corresponding to the image density of the image formed on the sheet 9.

When the sheet 9 fed from the paper feeding tray by the job controller 67 is detected by the media detector 14, the sheet type detector 68 detects the sheet type (the basis weight) detected by the media detector 14. The multiple sheets 9 may be continuously fed during the execution of the job by the job controller 67, for example. In this case, the sheet type detector 68 detects the type of the sheet 9 being currently carried. The sheet type detector 68 then notifies the post-processing device 3 of the type of the sheet 9 being currently carried.

The sheet type detector 68 may notify the job controller 67 of the sheet type detected by the media detector 14. When the sheet type detected by the media detector 14 is different from the sheet type identified based on the sheet information 69, the system speed may be modified based on the sheet type detected by the media detector 14. When the system speed is modified based on the sheet type detected by the media detector 14, the job controller 67 notifies the post-processing device 3 of the modified system speed.

When the CPU 72 executes the predetermined program 75, the controller 39 of the post-processing device 3 serves as a sheet type obtaining unit 77, a carrying controller 78 and an aligning controller 79.

The sheet type obtaining unit 77 obtains the sheet type sent from the image forming device 2. The image forming device 2, for example, sends the sheet type identified based on the sheet information 69 at the start of the execution of the job to the post-processing device 3. Therefore, the sheet type obtaining unit 77 obtains the sheet type sent from the image forming device 2 at the start of the execution of the job. The sheet type obtaining unit 77 stores the sheet type obtained from the image forming device 2 at the start of the execution of the job in the RAM 74 as a first sheet type. The first sheet type is the sheet type specified by the user.

After feeding the sheet 9, the image forming device 2 enables the media detector 14 to detect the sheet type, and sends the detected sheet type to the post-processing device 3. Every time the sheet 9 is fed in the image forming device 2, the sheet type obtaining unit 77 obtains the sheet type of the fed sheet 9. The sheet type obtaining unit 77 stores the sheet type obtained from the image forming device 2 during the execution of the job in the RAM 74 as a second sheet type. The second sheet type is the sheet type detected by the media detector 14.

The carrying controller 78 controls the carrying roller driving unit 80 and/or the path switch driving unit 82 to carry the sheet 9 along the carrying paths 30, 31 and 32 in the post-processing device 3. The carrying controller 78 drives the part such as the carrying roller 33 at the carrying speed matches the carrying speed of the sheet 9 in the image forming device 2 based on the system speed notified by the image forming device 2, and receives the sheet 9 ejected from the image fuming device 2. When the operation of the post-processing such as binding every predetermined number of sheets is specified in the detailed information of the job, the carrying controller 78 controls the switching member 35 to carry the sheet 9 received from the image forming device 2 to the post-processing unit 40.

The aligning controller 79 controls operations of the post-processing unit 40 to align the multiple sheets 9 in the tray 43 and performs the post-processing such as binding. The aligning controller 79 adjusts the aligning operation for aligning the sheet 9 corresponding to the type of the sheet 9 loaded on the top surface of the tray 43. The weight or the resistance of the surface of the sheet 9 differs depending on the type of the sheet 9 so that the behavior of the sheet 9 in the aligning operation differs depending on the type of the sheet 9. The aligning controller 79 adjusts the aligning operation depending on the type of the sheet 9, and controls to enable the sheet 9 loaded on the top surface of the tray 43 to be precisely aligned. The aligning controller 79 includes a counting part 91, a first aligning member controller 92, a second aligning member controller 93 and a stapler controller 94.

The counting part 91 counts the number of the loaded sheet 9 on the tray 43. Information such as binding N sheets 9 (N is the number larger than 1; N>1) is specified in the detailed information of the job, for example. In this case, the counting part 91 drives the stapler controller 94 after the number of the loaded sheet 9 on the tray 43 reaches N and the aligning operation by the aligning unit 44 is complete. The counting part 91 notifies the first aligning member controller 92 of the number of the loaded sheet 9 on the tray 43.

The first aligning member controller 92 controls the aligning operation in the carrying direction of the sheet 9 by the first aligning member 51. After an elapse of predetermined time T1 from the detection of the rear end of the sheet 9 by the sheet detector 41, the first aligning member controller 92 starts an operation to move the rotation member 53 (paddle 54) of the first aligning member 51 downward, and starts an operation to rotate the rotation member 53 (paddle 54) in a predetermined direction (R direction of FIG. 4). The first aligning member controller 92 reads the sheet type stored in the RAM 74, and identifies the type of the sheet 9 ejected on the tray 43. The first aligning member controller 92 determines a downward quantity of the rotation member 53 (paddle 54) based on the type of the sheet 9 and the number of the loaded sheet 9 on the tray 43. In addition, the first aligning member controller 92 determines the number of rotations of the rotation member 53 (paddle 54) based on the type of the sheet 9. More specifically, the first aligning member controller 92 performs the aligning operation suitable for the number of the loaded sheet 9 on the tray 43 and the sheet type of the sheet 9 placed on the top surface of the tray 43 so that the alignment failure in the carrying direction of the sheet 9 is prevented.

The first sheet type specified by the user and the second sheet type detected by the media detector 14 are stored in the RAM 74. The first sheet type may not match the type of the sheet actually being carried due to a mistake of the user setting. On the other hand, the second sheet type is the sheet type detected based on the value actually measured during the carrying of the sheet 9 by the media detector 14. In general, it can be said that the second sheet type is more accurate than the first sheet type.

The media detector 14 is capable of detecting the actual basis weight of the sheet 9 so that is enabled to detect the type of the sheet 9 more in detail within a basis weight range of the regular paper that is set by the user manually. It can be said that the second sheet type shows more in detail than the first sheet type.

When the user sets the special sheet by manual, it can be said that the first sheet type is correctly set. More specifically, the general user does not know the basis weight of the sheet 9 and the special sheet is not specified in the sheet setting screen G1 (see FIGS. 8A and 8B). If the special sheet is set by the user, it is considered that the user knew the correct basis weight. Therefore, the first sheet type can be treated as the sheet type correctly set by the user.

The first aligning member controller 92 compares the first sheet type stored in the RAM 74 and the second sheet type, and determines if the first sheet type and the second sheet type are different. When the first sheet type and the second sheet type are different, the first aligning member controller 92 preferentially adopts the second sheet type. The first aligning member controller 92 determines the downward quantity and the number of rotations of the rotation member 53 (paddle 54) based on the second sheet type. As a result, the first aligning member controller 92 is enabled to control the operation of the first aligning member 51 based on the accurate sheet type so that an occurance of the alignment failure in the carrying direction of the sheet 9 can be effectively prevented. When the first sheet type is the special sheet, the downward quantity and the number of rotations of the rotation member 53 (paddle 54) may be determined based on the first sheet type not the second sheet type.

When the first sheet type and the second sheet type are the same, the first aligning member controller 92 may adopt any one of the first and the second sheet types. In this case, the first aligning member controller 92 may, for example, determine the downward quantity and the number of rotations of the rotation member 53 (paddle 54) based on the first sheet type. The first aligning member controller 92 may determine the downward quantity and the number of rotations of the rotation member 53 (paddle 54) based on the second sheet type as the same as the case where the first sheet type and the second sheet type are different.

The first aligning member controller 92 may adjust the downward quantity and the number of rotations of the rotation member 53 (paddle 54) based on information such as the image density and/or the environmental information. The first aligning member controller 92 may, for example, obtain the image density notified by the image forming device 2 and adjust the downward quantity and the number of rotations of the rotation member 53 (paddle 54) based on the image density of the image formed on the sheet 9 that is to be aligned. The first aligning member controller 92 may obtain the environmental information such as temperature detected by the temperature sensor 101 and/or humidity detected by the humidity sensor 102 and adjust the downward quantity and the number of rotations of the rotation member 53 (paddle 54) based on the environmental information.

For determining the downward quantity and the number of rotations of the rotation member 53 (paddle 54), the first aligning member controller 92 reads the control information 76 stored in the ROM 73. The first aligning member controller 92 refers to the control information 76, and determines the downward quantity and the number of rotations of the rotation member 53 (paddle 54). The first aligning member controller 92 controls the operation of the first aligning member 51 and aligns the sheet 9 in the carrying direction of the sheet 9 based on the determined downward quantity and the number of rotations of the rotation member 53 (paddle 54).

The second aligning member controller 93 controls the aligning operation in the width direction of the sheet 9 by the second aligning member 52. After an elapse of predetermined time T2 from the detection of the rear end of the sheet 9 by the sheet detector 41, the second aligning member controller 93 starts an operation to move the aligning plates 52*a* and 52*b* of the second aligning member 52 in the width direction of the sheet 9. The predetermined time T2 is a sum of the time T1 required until the start of the operation by the first aligning member 51 and time Tx required from the start of the operation of the first aligning member 51 to the end (more specifically T2=T1+Tx). Hence, the second aligning member controller 93 starts the aligning operation by the second aligning member 52 after completion of the aligning operation by the first aligning member 51.

For starting the aligning operation by the second aligning member 52, the second aligning member controller 93 reads the sheet type stored in the RAM 74, and determines the number of times of drive of the aligning plates 52*a* and 52*b* based on the read sheet type. More specifically, the second aligning member controller 93 performs the aligning operation suitable for the sheet type of the sheet 9 placed on the top surface of the tray 43 so that the alignment failure in the width direction of the sheet 9 is prevented.

As the same as the first aligning member controller 92, the second aligning member controller 93 compares the first sheet type stored in the RAM 74 and the second sheet type, and determines if the first sheet type and the second sheet type are different. When the first sheet type and the second sheet type are different, the second aligning member controller 93 preferentially adopts the second sheet type. The second aligning member controller 93 determines the number of times of drive of the aligning plates 52*a* and 52*b* based on the second sheet type. As a result, the second aligning member controller 93 is enabled to control the operation of the second aligning member 52 based on the accurate sheet type, and an occurance of the alignment failure in the width direction of the sheet 9 on the tray 43 can be effectively prevented. When the first sheet type is the special sheet, the number of times of drive of the aligning plates 52*a* and 52*b* may be determined based on the first sheet type not the second sheet type.

When the first sheet type and the second sheet type are the same, the second aligning member controller 93 may adopt any one of the first and the second sheet types. In this case, the second aligning member controller 93 may, for example, determine the number of times of drive of the aligning plates 52*a* and 52*b* based on the first sheet type. The second aligning member controller 93 may determine the number of times of drive of the aligning plates 52*a* and 52*b* based on the second sheet type as the same as the case where the first sheet type and the second sheet type are different.

For determining the number of times of drive of the aligning plates 52*a* and 52*b*, the second aligning member controller 93 reads the control information 76 stored in the ROM 73. The second aligning member controller 93 refers to the control information 76, and determines the number of times of drive of the aligning plates 52*a* and 52*b*. The second aligning member controller 93 controls the operation of the second aligning member 52 and aligns the sheet 9 in the width direction of the sheet 9 based on the determined number of times of drive of the aligning plates 52*a* and 52*b*.

The stapler controller 94 controls the binding operation by the stapler 45. After the completion of the aligning operation by the second aligning member 52, the stapler controller 94 drives the stapler 45 to bind with the needle at a predetermined position of the multiple sheets 9 placed on the tray 43. The operation to move the stapler 45 to the binding position should preferably be done before the operation of the second aligning member 52 completes.

For driving the stapler 45 to perform binding, the stapler controller 94 reads the control information 76 stored in the ROM 73. The stapler controller 94 refers to the control information 76, and determines the voltage of drive for driving the stapler 45. The stapler controller 94 adjusts the voltage of drive of the stapler 45, and is enabled to control the speed until the binding operation by the stapler 45 completes.

Figure 10:
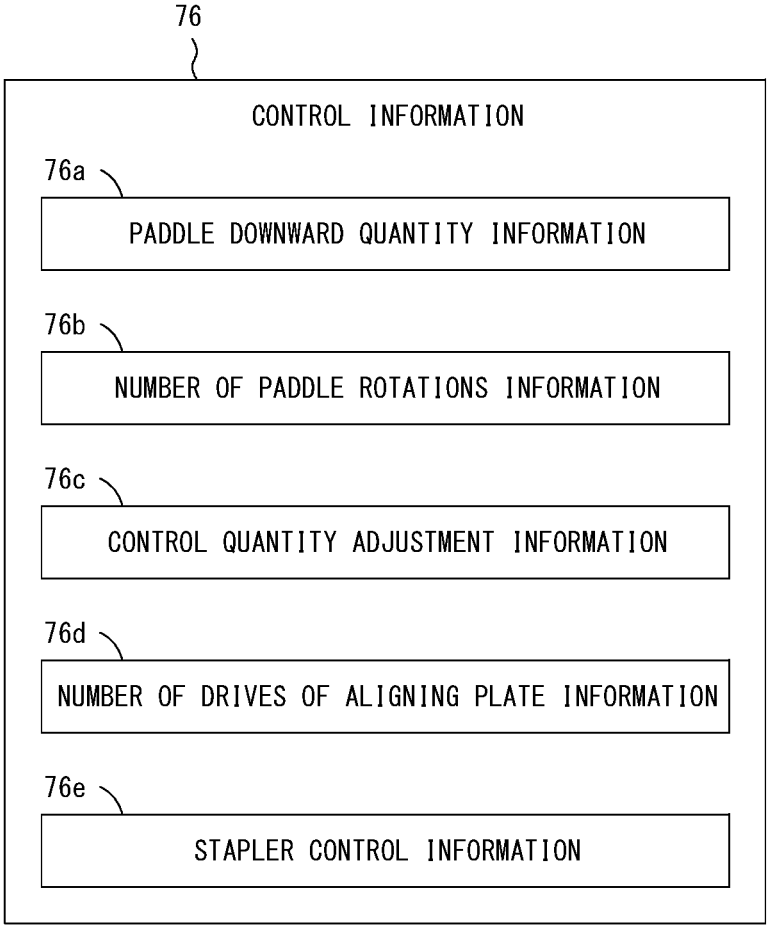
FIG. 10 illustrates an example of a structure of control information.

FIG. 10 illustrates an example of a structure of the control information 76. The control information 76 includes paddle downward quantity information 76*a*, number of paddle rotations information 76*b*, control quantity adjustment information 76*c*, number of drives of aligning plate information 76*d* and stapler control information 76*e*.

FIG. 11 illustrates an example of the paddle downward quantity information 76*a*. The paddle downward quantity information 76*a* is referred by the first aligning member controller 92 for determining the downward quantity of the rotation member 53 (paddle 54). With paddle downward quantity information 76*a*, the downward quantity of the rotation member 53 (paddle 54) may be determined depending on the sheet type and the number of sheets loaded on the tray 43. The sheet type has two classifications, a first classification and a second classification. The thin paper, the regular paper, the thick paper 1, the thick paper 2, the thick paper 3 and the thick paper 4 are in the first classification. The second classification is classified by the basis weight. The regular paper in the first classification is, for instance, divided into four groups in the second classification. In the second classification, sheet type can be identified more in detail than the first classification. The first classification corresponds to the first sheet type and the second classification corresponds to the second sheet type. The first aligning member controller 92 refers to the paddle downward quantity information 76*a*, and is enabled to determine the downward quantity of the rotation member 53 (paddle 54) based on the second sheet type and the number of sheets loaded on the tray 43. Especially, when the basis weight of the sheet type of the second sheet is within the range of 41 to 91 g/m$^2$, the first aligning member controller 92 is enabled to provide the detailed control corresponding to the basis weight compared to the uniform control for the "regular paper."

It is set in the paddle downward quantity information 76*a*, for example, that as the number of the loaded sheets on the tray 43 increases, the downward quantity of the rotation member 53 (paddle 54) decreases. It is set that the level of decrease in the downward quantity of the rotation member 53 (paddle 54) for the thick paper is larger than that for the thin paper. As the number of the loaded sheets on the tray 43 increases, the sheet 9 of the top surface gets closer to the rotation member 53. The downward quantity of the rotation member 53 (paddle 54) is reduced in accordance with the increase in the number of the loaded sheets on the tray 43, and the contact pressure between the paddle 54 and the sheet 9 is remained constant, resulting in prevention of the alignment failure.

In the paddle downward quantity information 76*a*, the downward quantity of the rotation member 53 (paddle 54) for the thick paper is set at a smaller value than the thin paper. More specifically, the thick paper has the larger thickness of the sheet 9 than the thin paper. The downward quantity of the rotation member 53 is made small so that the distance between the rotation member 53 (paddle 54) and the upper surface of the sheet 9 is kept constant even the sheet is the thin paper or the thick paper, resulting in prevention of the alignment failure.

In the paddle downward quantity information 76*a*, the downward quantity of the rotation member 53 (paddle 54) is set for the basis weight corresponding to the recycled paper in the regular paper area. In general, the user may recognize the sheet 9 is the regular paper but it is difficult to distinguish the sheet 9 is the recycled paper. Among the regular paper, the basis weight of the recycled paper is small. The recycled paper easily generates curl and the alignment failure is likely to occur. If the downward quantity of the rotation member 53 (paddle 54) is determined based on the basis weight of the second sheet type, the downward quantity suitable for the recycled paper may be determined. It is possible to prevent the occurrence of the alignment failure.

FIG. 12 illustrates an example of the number of paddle rotations information 76*b*. The number of paddle rotations information 76*b* is referred by the first aligning member controller 92 for determining the number of rotations of the rotation member 53 (paddle 54). With the number of paddle rotations information 76*b*, the number of rotations of the rotation member 53 (paddle 54) may be determined depending on the sheet type. As the same as above, the sheet type has two classifications, a first classification and a second classification. The thin paper, the regular paper, the thick paper 1, the thick paper 2, the thick paper 3 and the thick paper 4 are in the first classification. The second classification is classified by the basis weight. The second classification makes it possible to identify the sheet type more in detail than the first classification. The first classification corresponds to the first sheet type and the second classification corresponds to the second sheet type. The first aligning member controller 92 refers to the number of paddle rotations information 76*b*, and is enabled to determine the number of rotations of the rotation member 53 (paddle 54) based on the second sheet type.

In the example of FIG. 12, for instance, for the sheet type, the basis weight of which is relatively small, such as the paper from the thin paper to the regular paper, the number of rotations of the rotation member 53 (paddle 54) is set to a predetermined number of times (two rotations). If the sheet is the thin paper or the regular paper, the sheet 9 must be light and have less resistance. The sheet 9 is then enabled to be moved smoothly toward the stopper 58. On the other hand, in case of the thick paper, the weight of the sheet 9 increases, and the resistance gets larger. Thus, the number of rotations of the rotation member 53 (paddle 54) is set to three rotations which is more than the predetermined number of times for the thin paper or the regular paper. To be more specific, the rotation member 53 (paddle 54) is rotated for three times so that the rear end of the thick paper which has the larger resistance is butted against the stopper 58. It is possible to prevent the occurrence of the alignment failure.

When the number of rotations of the rotation member 53 (paddle 54) is three, it takes longer time to complete the aligning operation in the carrying direction of the sheet 9 by the first aligning member 51 than in case of two rotations. The timing to start the aligning operation in the width direction of the sheet 9 by the second aligning member 52 is delayed. When the number of rotations of the rotation member 53 (paddle 54) is set to three rotations which is more than two rotations that is the usual number of rotations, the first aligning member controller 92 performs a sheet interval enlarging process as stated in the number of paddle rotations information 76*b*. More specifically, the first aligning member controller 92 sends a sheet interval enlarging request to the controller 8 of the image forming device 2 and requests for enlarging the sheet intervals between the sheets 9 that follow. The sheet interval in the image forming device 2 is then enlarged than the initial interval. Thus, it is prevented that the following sheet is ejected on the tray 43 even without the completion of the aligning operation by the second aligning member 52.

FIG. 13 illustrates an example of the control quantity adjustment information 76*c*. The control quantity adjustment information 76*c* is referred by the first aligning member controller 92 for adjusting the downward quantity and the number of rotations of the rotation member 53 (paddle 54) determined as described above based on the information including the image density and/or the environmental information. As illustrated in FIG. 13, it is stated to adjust the downward quantity and the number of rotations of the rotation member 53 (paddle 54) based on the image density, temperature and humidity in the control quantity adjustment information 76*c*.

In the control quantity adjustment information 76*c*, for instance, it is stated to reduce the downward quantity of the rotation member 53 and to increase the number of rotations of the rotation member 53 when the image density is darker than a predetermined density. When the image density is dark, the resistance of the sheet 9 gets larger. Thus, the downward quantity of the rotation member 53 is reduced and the number of rotations of the rotation member 53 is increased so that the rear end of the thick paper which has the larger resistance can be butted against the stopper 58. When the image density is dark, the number of rotations of the rotation member 53 increases. The first aligning member controller 92 requests for enlarging the sheet intervals. When the image density is lighter than the predetermined density, the downward quantity and the number of rotations of the rotation member 53 are not adjusted.

In the control quantity adjustment information 76*c*, for instance, it is stated to reduce the downward quantity of the rotation member 53 and to increase the number of rotations of the rotation member 53 when the temperature is higher than predetermined temperature. If the temperature in the device gets higher than the predetermined temperature, the sheet 9 easily generates curl and the alignment failure is likely to occur. When the temperature is high, the downward quantity of the rotation member 53 is reduced and the number of rotations of the rotation member 53 is increased to prevent the alignment failure of the sheet 9. When the temperature in the device is higher than the predetermined temperature, the number of rotations of the rotation member 53 increases. The first aligning member controller 92 performs the operation to enlarge the sheet intervals. When the temperature in the device is lower than the predetermined temperature, the downward quantity and the number of rotations of the rotation member 53 are not adjusted.

In the control quantity adjustment information 76*c*, for instance, it is stated to reduce the downward quantity of the rotation member 53 and to increase the number of rotations of the rotation member 53 when the humidity is higher than predetermined humidity. If the humidity in the device gets higher than the predetermined humidity, the sheet 9 easily generates curl and/or waviness and the alignment failure is likely to occur. When the humidity is high, the downward quantity of the rotation member 53 is reduced and the number of rotations of the rotation member 53 is increased to prevent the alignment failure of the sheet 9. When the humidity in the device is higher than the predetermined humidity, the number of rotations of the rotation member 53 increases. The first aligning member controller 92 performs the operation to enlarge the sheet intervals. When the humidity in the device is lower than the predetermined humidity, the downward quantity and the number of rotations of the rotation member 53 are not adjusted.

FIG. 14A illustrates an example of the number of drives of aligning plate information 76*d*. The number of drives of aligning plate information 76*d* is referred by the second aligning member controller 93 for determining the number of times of drive of the aligning plates 52*a* and 52*b*. With the number of drives of aligning plate information 76*d*, the number of times of drive of the aligning plates 52*a* and 52*b* may be determined depending on the sheet type. The sheet type has two classifications, a first classification and a second classification. The thin paper, the regular paper, the thick paper 1, the thick paper 2, the thick paper 3 and the thick paper 4 are in the first classification. The second classification is classified by the basis weight. The regular paper in the first classification is, for instance, divided into four groups in the second classification. In the second classification, sheet type can be identified more in detail than the first classification. The first classification corresponds to the first sheet type and the second classification corresponds to the second sheet type. The second aligning member controller 93 refers to the number of drive of aligning plate information 76*d*, and is enabled to determine the number of times of drive of the aligning plates 52*a* and 52*b* based on the second sheet type. Especially, in case of the "recycled paper" that shows the basis weight of the sheet type of the second sheet being within the range of 41 to 91 g/m$^2$, the second aligning member controller 93 is enabled to determine the number of times of drive, which is different number from that for the regular paper than the recycled paper.

When the sheet 9 is the thin paper or the recycled paper, the sheet 9 easily generates curl and the alignment failure is likely to occur. The regular paper and the thick paper besides the recycled paper does not easily generate curl. For the regular paper and the thick paper besides the recycled paper, the number of times of drive of the aligning plates 52*a* and 52*b* is set to a predetermined number of times (once) in the number of drives of aligning plate information 76*d*. In case of the thin paper or the recycled paper, the number of times of drive is set to two times which is more than the predetermined number of times (once) for the regular paper or the thick paper besides the recycled paper. It is possible to prevent the occurrence of the alignment failure in case of the thin paper or the recycled paper.

When the number of times of drive is set to two times which is more than the predetermined number of times (once), time required until completing the aligning operation by the second aligning member 52 gets longer. When the number of times of drive of the aligning plates 52*a* and 52*b* is set to two times which is more than the predetermined number of times (once), the second aligning member controller 93 may perform the sheet interval enlarging process. The sheet interval in the image forming device 2 is then enlarged than the initial interval. Thus, it is prevented that the following sheet is ejected on the tray 43 even without the completion of the aligning operation by the second aligning member 52.

FIG. 14B illustrates an example of the stapler control information 76*e*. The stapler control information 76*e* is referred by the stapler controller 94 for determining the voltage of drive to drive the stapler 45. With the stapler control information 76*e*, the voltage of drive of the stapler 45 may be determined depending on the sheet type. The sheet type has two classifications, a first classification and a second classification. The thin paper, the regular paper, the thick paper 1, the thick paper 2, the thick paper 3 and the thick paper 4 are in the first classification. The second classification is classified by the basis weight. The first classification corresponds to the first sheet type and the second classification corresponds to the second sheet type. The stapler controller 94 refers to the stapler control information 76*e*, and is enabled to determine the voltage of drive of the stapler 45 based on the second sheet type.

When the sheet 9 is the thick paper, the number of rotations of the rotation member 53 (paddle 54) is set to three times as described above. The time required until completing the aligning operation by the first aligning member 51 gets longer. When the sheet type is the thin paper or the recycled paper, the number of times of drive of the aligning plates 52*a* and 52*b* is set to two times. The time required until completing the aligning operation by the second aligning member 52 gets longer. The voltage of drive for the sheet type (the thick paper, the thin paper and the recycled paper) that takes the longer time for the aligning operation by the first aligning member 51 or the second aligning member 52 is set to a higher value than a regular value in the stapler control information 76*e*. Thus, the speed of the binding operation by the stapler 45 is set to high and the binding operation can be completed effectively. The voltage of drive for the sheet type (the regular paper besides the recycled paper) that does not take the longer time for the aligning operation by the first aligning member 51 or the second aligning member 52 is set to the regular value.

As described above, the voltage of drive for the sheet type (the thick paper, the thin paper and the recycled paper) that takes the longer time for the aligning operation by the first aligning member 51 or the second aligning member 52 is set to a higher value than the regular value in the stapler control information 76*e*. As a result, the time required for the binding operation by the stapler 45 can be shortened. For enlarging the sheet intervals in the image forming device 2, it is not necessary to highly enlarge the sheet intervals, and the extreme degradation of throughput on the image forming system 1 can be prevented.

After completing the binding operation of the multiple sheets 9 placed on the tray 43, the controller 39 eject the bundle of sheets on the tray 43 to the second ejecting tray 38.

Figure 15:
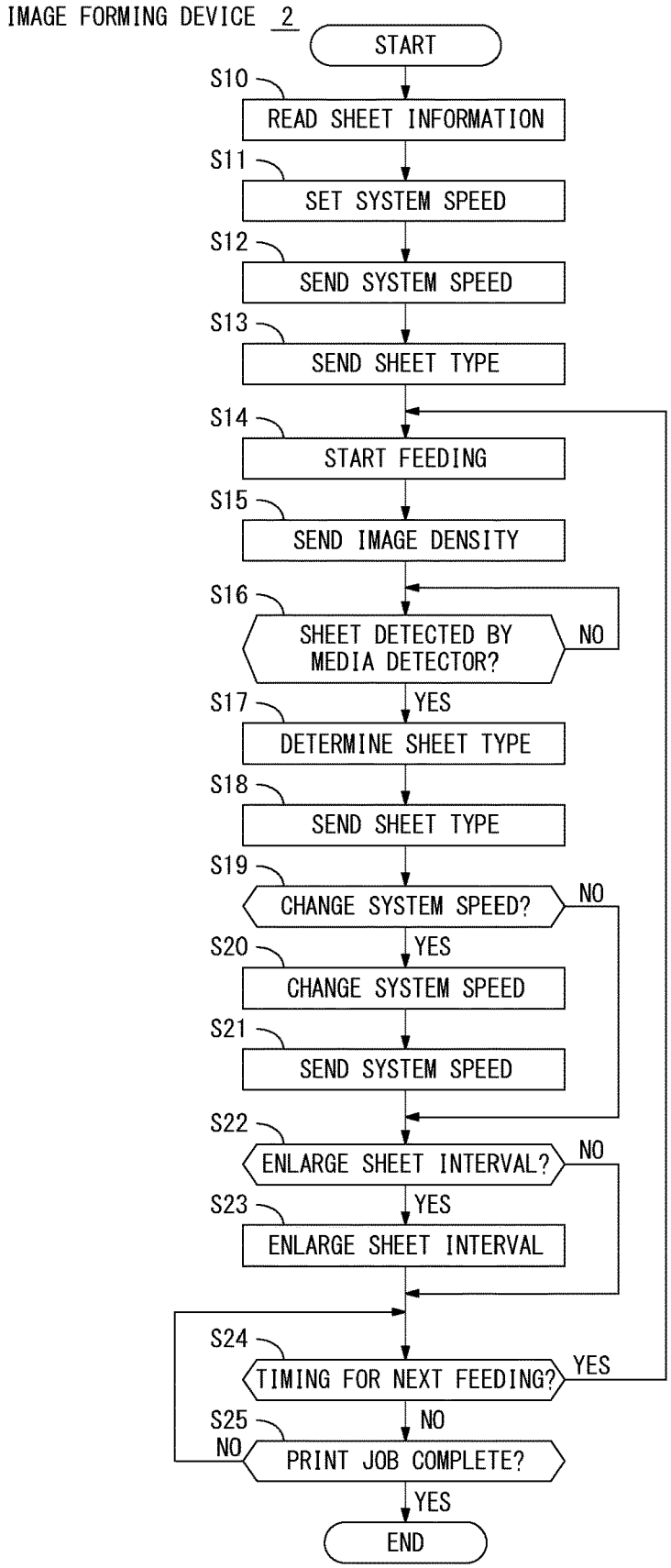
FIG. 15 illustrates flow diagrams explaining an exemplary procedure of a process performed in the image forming device.

An example of the detailed operation in the image forming device 2 is explained. FIG. 15 illustrates a flow diagram explaining an exemplary procedure of a process performed in the image forming device 2. This process is performed when the CPU 63 of the image forming device 2 executes the program. The process is also performed when the execution of the job is instructed by the user, for example.

Upon start of the process, the image forming device 2 reads the sheet information 69 in the storage 61, and identifies the type of the sheet 9 stored in the paper feeding tray selected by the user (step S10). The image forming device 2 sets the system speed based on the identified type of the sheet 9 (step S11), and sends the system speed to the post-processing device 3 (step S12). The image forming device 2 sends the sheet type identified based on the sheet information 69 to the post-processing device 3 (step S13).

The image forming device 2 sets the carrying speed of the sheet 9 based on the system speed, and starts feeding the sheet 9 from the paper feeding tray selected by the user (step S14). The image forming device 2 then drives the image forming unit 20 at a predetermined timing, and starts the image forming operation based on the image data to print. The image forming device 2 calculates the image density based on the image data to print, and sends the calculated image density to the post-processing device 3 (step S15).

The image forming device 2 waits until the sheet 9 fed from the paper feeding tray is detected by the media detector 14 (when a result of step S16 is NO). Once the sheet 9 is detected by the media detector 14 (when a result of step S16 is YES), the image forming device 2 determines the sheet type (step S17), and sends the sheet type detected by the media detector 14 to the post-processing device 3 (step S18).

The image forming device 2 then determines if it is necessary to change the system speed based on the sheet type detected by the media detector 14 (step S19). If it is necessary to change the system speed (when a result of step S19 is YES), the image forming device 2 changes the system speed (step S20), and sends the changed system speed to the post-processing device 3. (step S21). If it is not necessary to change the system speed (when a result of step S19 is NO), the process in steps S20 and S21 is skipped.

The image forming device 2 determines if the sheet interval enlarging request is received from the post-processing device 3 (step S22). When the sheet interval enlarging request is received (when a result of step S22 is YES), the image forming device 2 enlarges the sheet intervals between the following sheets 9 (step S23). The image forming device 2 extends the time that the tip end of the following sheet 9 waits at the position of the timing roller 15 so that the sheet interval between the first sheet 9 and the following sheet 9 can be enlarged. The process to enlarge the sheet interval does not have to be the one as described above. The sheet interval may be enlarged by delaying the timing to feed the next sheet 9 from the paper feeding tray, for example. When the sheet interval enlarging request is not received (when a result of step S22 is NO), the process in step S23 is skipped.

The image forming device 2 determines if it is the timing to feed the next sheet 9 (step S24). It may be the timing to feed the next sheet 9 (when a result of step S24 is YES). The process by the image forming device 2 then returns to step S14 to repeat the above-described process. It may not be the timing to feed the next sheet 9 (when a result of step S24 is NO). The image forming device 2 then determines whether or not the job is to complete (step S25). If the job is not to complete (when a result of step S25 is NO), the process by the image forming device 2 returns to step S24. When the job is complete, the process in the image forming device 2 is complete.

Figure 16:
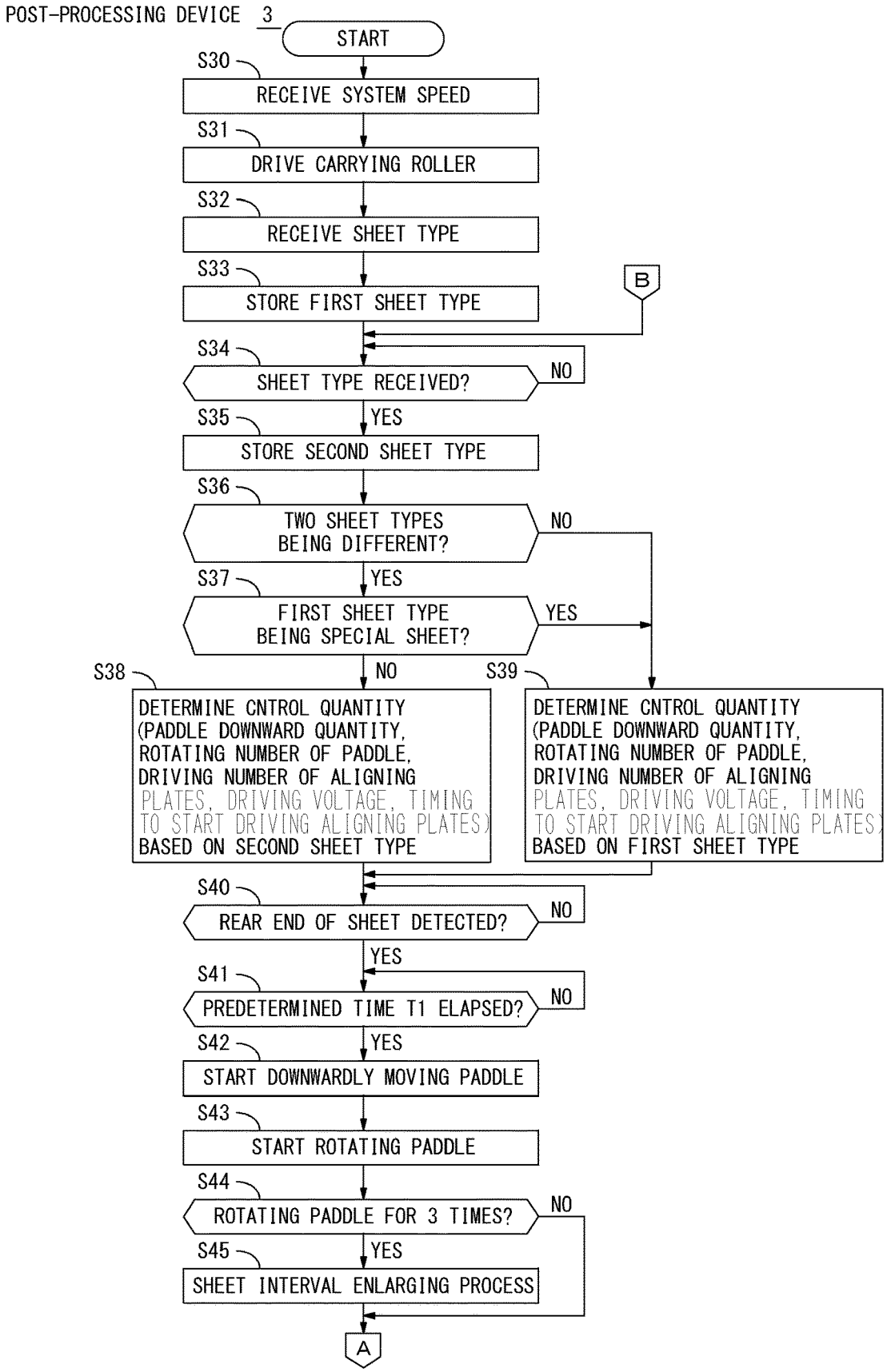
FIG. 16 illustrates flow diagrams explaining an exemplary procedure of a process performed in the post-processing device.
Figure 17:
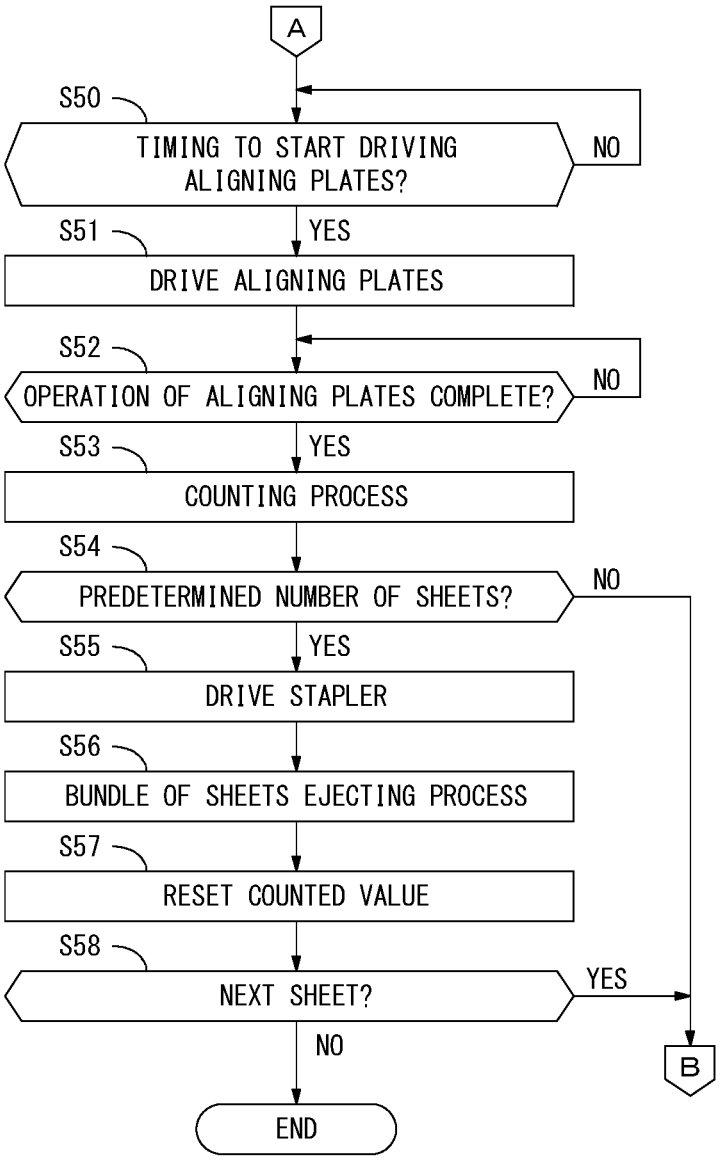
FIG. 17 illustrates flow diagrams explaining an exemplary procedure of a process performed in the post-processing device.

An example of the detailed operation in the post-processing device 3 is explained. FIGS. 16 and 17 illustrate flow diagrams explaining an exemplary procedure of a process performed in the post-processing device 3. This process is performed when the CPU 72 of the post-processing device 3 executes the program 75. The process is also performed when the execution of the job is started by the user, for example.

Upon start of the process, the post-processing device 3 receives the system speed sent from the image forming device 2 (step S30). The post-processing device 3 sets the carrying speed of the sheet 9 based on the system speed, and drives the carrying roller 33 (step S31). The post-processing device 3 receives the sheet type sent from the image forming device 2 (step S32), and stores the received sheet type as the first sheet type in the RAM 74 (step S33).

After the feeding operation of the sheet 9 is performed in the image forming device 2, the post-processing device 3 waits until receiving the sheet type detected by the media detector 14 (step S34). After receiving the sheet type detected by the media detector 14 (when a result of step S34 is YES), the post-processing device 3 stores the received sheet type as the second sheet type in the RAM 74 (step S35).

The post-processing device 3 compares the first sheet type and the second sheet type, and determines if those sheet types are different (step S36). When the sheet types are different (when a result of step S36 is YES), the post-processing device 3 determines if the first sheet type is the special sheet (step S37). If the first sheet type is not the special sheet (when a result of step S37 is NO), the post-processing device 3 determines the quantity of control for enabling the post processing unit 40 to operate based on the second sheet type of the first and the second sheet types (step S38). More specifically, the post-processing device 3 determines the downward quantity and the number of rotations of the rotation member 53 (paddle 54), the number of times of drive of the aligning plates 52*a* and 52*b*, and the voltage of drive of the stapler 45 based on the basis weight specified for the second sheet type and the control information 76 stored in the ROM 73. The post-processing device 3 also determines the timing to start driving the aligning plates 52*a* and 52*b* (timing equivalent to the above-described predetermined time T2) based on the determined number of rotations of the rotation member 53 (paddle 54).

When the first sheet type and the second sheet type are the same (when a result of step S36 is NO), or the first sheet type is the special sheet (when a result of step S37 is YES), the post-processing device 3 determines the quantity of control for enabling the post processing unit 40 to operate based on the first sheet type of the first and the second sheet types (step S39). It is assumed that, for example, the first sheet type is the "regular paper." In this case, the post-processing device 3 refers to the value of the basis weight 81 to 90 g/m$^2$ in the control information 76 to determine the downward quantity and the number of rotations of the rotation member 53 (paddle 54), the number of times of drive of the aligning plates 52*a* and 52*b*, and the voltage of drive of the stapler 45. The post-processing device 3 also determines the timing to start driving the aligning plates 52*a* and 52*b* (timing equivalent to the above-described predetermined time T2) based on the determined number of rotations of the rotation member 53 (paddle 54).

However, this is given not for limitation. When the first sheet type and the second sheet type are the same (when a result of step S36 is NO), or the first sheet type is the special sheet (when a result of step S37 is YES), the post-processing device 3 may determine the quantity of control for enabling the post processing unit 40 to operate based on the second sheet type.

After determining the quantity of control for enabling the post processing unit 40 to operate in the above-described steps S38 and S39, the post-processing device 3 waits until the rear end of the sheet 9 is detected by the sheet detector 41 (step S40). Once the rear end of the sheet 9 is detected by the sheet detector 41 (when a result of step S40 is YES), the post-processing device 3 waits until the predetermined time T1 elapses (step S41). The predetermined time T1 is the time required for the rear end of the sheet 9 detected by the sheet detector 41 to go through the pair of rollers 42 and ejected on the tray 43.

After the elapse of the predetermined time T1 (when a result of step S41 is YES), the post-processing device 3 starts moving the rotation member 53 (paddle 54) of the first aligning member 51 (step S42). The post-processing device 3 keeps moving the rotation member 53 (paddle 54) downward until the downward quantity reaches the value determined in the step S38 or S39.

As starting the downward operation of the rotation member 53 (paddle 54), the post-processing device 3 starts rotating the rotation member 53 (paddle 54) of the first aligning member 51 downward (step S43). The post-processing device 3 keeps rotating the rotation member 53 (paddle 54) until the number of rotations reaches the value determined in the step S38 or S39. The rotation member 53, for instance, rotates once during the downward operation, and rotates once or twice after the downward operation. As a result, the sheet 9 ejected on the tray 43 can be aligned along the carrying direction of the sheet 9.

As starting the rotation of the rotation member 53 (paddle 54), the post-processing device 3 determines if the number of rotations is three which is more than the predetermined number of rotations (two rotations) (step S44). As a result, when the number of rotations is three, the post-processing device 3 performs the sheet interval enlarging process (step S45). More specifically, the post-processing device 3 sends the sheet interval enlarging request to the image forming device 2, and performs the process to enlarge the sheet intervals between the following sheets 9. If the number of rotations is not three (when a result of step S44 is NO), the process in step S45 is skipped.

Moving to the process in the flow diagram of FIG. 17, the post-processing device 3 determines if the predetermined time T2 has elapsed after the rear end of the sheet 9 is detected by the sheet detector 41 and it is the timing to start driving the aligning plate (step S50). If it is the timing to start driving the aligning plate, the rotation operation of the paddle 54 should be completed. Thus, when it is the timing to start driving the aligning plate (when a result of step S50 is YES), the post-processing device 3 moves the rotation member 53 (paddle 54) up, and puts it back to the waiting position.

The timing that the controller 39 of the post-processing device 3 determines to start the operation of the second aligning member 52 differs for the case where the paddle rotates twice or the case where the paddle rotates three times. Whether the paddle rotates twice or three times is determined based on the sheet type in the steps S38 and S39. In this case, the controller 39 of the post-processing device 3 adjusts the timing to determine to start the operation of the second aligning member 52 in step S50 based on the sheet type. The controller 39 adjusts the timing to start the operation of the second aligning member 52 based on the sheet type so that it can prevent the operation of the second aligning member 52 from being performed at the same time as to the operation of the first aligning member 51. With each operation, the sheet 9 can be appropriately aligned in the carrying direction and the width direction. In step S50, the post-processing device 3 may determine if the rotation operation of the paddle 54 of the first aligning member 51 is completed.

The post-processing device 3 waits until the operation of the aligning plates 52*a* and 52*b* of the second aligning member 52 completes (step S52). Once the operation of the aligning plates 52*a* and 52*b* completes (when a result of step S52 is YES), the post-processing device 3 performs the counting operation of the sheet 9 (step S53). With the counting operation, the number of the sheet 9 placed on the tray 43 is updated. The post-processing device 3 then determines if the number of the sheet 9 placed on the tray 43 has reached the predetermined number (step S54). When the number of the sheet 9 placed on the tray 43 has not reached the predetermined number (when a result of step S54 is NO), the post-processing device 3 goes back to step S34 of FIG. 16 and repeats the above-described process.

When the number of the sheet 9 placed on the tray 43 has reached the predetermined number (when a result of step S54 is YES), the post-processing device 3 drives the stapler 45 and creates the bundle of sheets 9, that is made by the predetermined number of the sheets 9 bound with the needle (step S55). The post-processing device 3 supplies the driving voltage determined in steps S38 and S39 of FIG. 16 to the stapler 45. As a result, the stapler 45 operates at a speed corresponding to the driving voltage and binds the predetermined number of the sheets 9 with the needle.

After the binding with the needle by the stapler 45 is performed, the post-processing device 3 ejects the bundle of sheets on the tray 43 to the second ejecting tray 38 (step S56). More specifically, the post-processing device 3 moves the roller 46 toward the roller 47, and sandwiches the bundle of sheets between the roller 46 and the roller 47. The rollers 46 and 47 are rotated, and the bundle of sheets is ejected to the second ejecting tray 38. After the operation to eject the bundle of sheets, the post-processing device 3 resets the number of the sheets 9 placed on the tray 43 to 0 (step S57).

The post-processing device 3 then determines if the next sheet 9 is to be carried (step S58). If the next sheet 9 is to be carried (when a result of step S58 is YES), the process in the post-processing device 3 goes back to step S34 of FIG. 16 and repeats the above-described process. If there is no next sheet 9 (when a result of step S58 is NO), the job is complete and the process in the post-processing device 3 completes.

The post-processing device 3 of the present embodiment obtains the first sheet type specified by the user and the second sheet type detected by the media detector 14 installed in the carrying path 13 of the sheet 9. When the first sheet type and the second sheet type are different, the post-processing device 3 preferably applies the second sheet type and controls the operation of the post-processing unit 40 based on the second sheet type. Even when the user sets the wrong sheet type to set the type of the sheet 9 by manual, the post-processing device 3 controls the operation of the post-processing unit 40 based on the second sheet type so that the appropriate post-processing based on the accurate sheet type can be performed.

The post-processing device 3 of the present embodiment obtains the first sheet type specified by the user and the second sheet type detected by the media detector 14 installed in the carrying path 13 of the sheet 9. When the second sheet type is detected more in detail than the first sheet type, the post-processing device 3 is capable of controlling the operation of the post-processing unit 40 based on the second sheet type. More specifically, even when the user simply sets "regular paper," the post-processing device 3 identifies the more detailed sheet type of the "regular paper" based on the second sheet type, and controls the operation of the post-processing unit 40. The post-processing device 3 of the present embodiment, therefore, is enabled to finely control the operation of the post-processing unit 40 based on the sheet type which is more in detail than the sheet type set by the user by manual, and is capable of performing the appropriate post-processing corresponding to the type of the sheet 9.

The media detector 14 detects the sheet type every time the sheet 9 goes through the carrying path 13. Hence, the post-processing device 3 is capable of changing the operation of the post-processing unit 40 for each sheet. Even when the multiple types of the sheets are in the single paper feeding tray, the post-processing suitable for the type of the sheet 9 fed from the paper feeding tray may be performed.

The post-processing device 3 includes the aligning unit 44 that aligns the sheet 9 placed on the tray 43. The post-processing device 3 is configured to control the operation of the aligning unit 44 based on the second sheet type. Thus, the aligning failure of the sheet 9 on the tray 43 can be prevented, and the post-processing including binding by the stapler 45 can be performed appropriately.

Although the embodiments of the present invention have been described and illustrated in detail, it is clearly understood that the same is by way of illustration and example only and not limitation, the scope of the present invention should be interpreted by terms of the appended claims (Modifications)

While the preferred embodiment of the present invention has been described above, the present invention is not limited to the preferred embodiments. Various modifications may be applied to the present invention.

In the above-described preferred embodiment, for example, the media detector 14 is installed in the carrying path 13 in the image forming device 2. The media detector 14 may be installed in the carrying path in the post-processing device 3 not in the carrying path in the image forming device 2.

In the above-described preferred embodiment, the aligning operation of the sheet 9 on the tray 43 and the binding operation by the stapler 45 are controlled based on the sheet type. The subject of the control based on the sheet type is not limited to the aligning operation and the binding operation. The punching operation by the punch 34, for example, may be controlled by the post-processing device 3 based on the sheet type besides the aligning operation and the binding operation.

In the above-described preferred embodiment, for controlling the aligning operation based on the sheet type, the post-processing device 3 controls the downward quantity of the rotation member 53 (paddle 54), the number of rotations of the rotation member 53 (paddle 54), the number of times of drive of the aligning plates 52*a* and 52*b*, the voltage of drive of the stapler 45 and the timing to start driving the aligning plates 52*a* and 52*b*. However, this is given not for limitation. For controlling the aligning operation, for example, the post-processing device 3 may control at least one of the downward quantities of the rotation member 53 (paddle 54), the number of rotations of the rotation member 53 (paddle 54), the number of times of drive of the aligning plates 52*a* and 52*b*, the voltage of drive of the stapler 45 and the timing to start driving the aligning plates 52*a* and 52*b*.

In the above-described embodiments, the program 75 executed by the CPU 72 of the post-processing device 3 is stored in advance in the ROM 73. The program 75 does not have to be the one provided to the post-processing device 3 being installed in advance. The program 75 may be provided to the post-processing device 3 in a manner that is recorded on a computer readable recording medium such as a USB memory, and can be installed in the post-processing device 3. The program 75 may also be provided as a program installable in the post-processing device 3 by being downloaded over the network such as an internet.

What is claimed is:

1. A post-processing device, comprising:

a tray that accepts a carried sheet and places thereon;

a post-processing unit that performs a post-processing to the sheet placed on the tray; and a controller that controls an operation of the post-processing unit, wherein the controller:

obtains both of:

a first sheet type specified by a user; and a second sheet type detected by a media detector that is installed on a sheet carrying path; and controls the operation of the post-processing unit based on the second sheet type when the first sheet type and the second sheet type are different.

2. A post-processing device, comprising:

a tray that accepts a carried sheet and places thereon;

a post-processing unit that performs a post-processing to the sheet placed on the tray; and a controller that controls an operation of the post-processing unit, wherein the controller:

obtains both of:

a first sheet type specified by a user; and a second sheet type detected by a media detector that is installed on a sheet carrying path; and controls the operation of the post-processing unit based on the second sheet type when the second sheet type is detected more in detail than the first sheet type.

3. The post-processing device according to claim 1, wherein:

the post-processing unit comprises an aligning unit that aligns the sheet placed on the tray, and the controller controls an operation of the aligning unit based on the second sheet type.

4. The post-processing device according to claim 3, wherein the aligning unit comprises a first aligning member that aligns the sheet placed on the tray in a carrying direction, and the controller controls an operation of the first aligning member based on second sheet type.

5. The post-processing device according to claim 4, wherein the first aligning member:

is enabled to be lifted up and down above the tray;

is moved downward at a timing that the sheet is ejected between the tray and the first aligning member; and holds an upper surface of the sheet and places on a top surface of the tray, and the controller adjusts downward quantity of the first aligning member based on the second sheet type.

6. The post-processing device according to claim 5, wherein when the second sheet type is a thick paper, the controller reduces the downward quantity of the first aligning member compared to a thin paper.

7. The post-processing device according to claim 5, wherein the controller further adjusts the downward quantity of the first aligning member according to the number of the sheet placed on the tray.

8. The post-processing device according to claim 4, wherein the tray comprises a stopper that restricts movement of the sheet in the carrying direction, the first aligning member comprises a rotation member that:

gets in contact with the sheet placed on the top surface of the tray; and rotates to enable the sheet to but against the stopper and to be aligned, and the controller adjusts the number of rotations of the rotation member based on the second sheet type.

9. The post-processing device according to claim 8, wherein the controller adjusts the number of rotations of the rotation member according to the number of the sheet placed on the tray.

10. The post-processing device according to claim 9, wherein in order to increase the number of rotations of the rotation member to a larger number of times than a predetermined number of times, the controller performs a control to expand a carrying interval of the sheets from an initial interval.

11. The post-processing device according to claim 3, wherein the aligning unit comprises a second aligning member that aligns the sheet placed on the tray in a direction orthogonal to the carrying direction, and the controller controls an operation of the second aligning member based on second sheet type.

12. The post-processing device according to claim 11, wherein the controller adjusts a timing to start the operation of the second aligning member based on the second sheet type.

13. The post-processing device according to claim 11, wherein the controller adjusts the number of operations of the second aligning member based on the second sheet type.

14. The post-processing device according to claim 13, wherein in order to increase the number of operations of the second aligning member to a larger number of times than a predetermined number of times, the controller performs a control to expand the carrying interval of the sheets than the initial interval.

15. The post-processing device according to claim 3, wherein:

the post-processing unit further comprises a stapler that staples a predetermined number of sheets after the predetermined number of sheets are placed on the tray and are aligned by the aligning unit, and the controller controls the operation of the stapler based on the second sheet type.

16. The post-processing device according to claim 15, wherein the controller adjusts a driving voltage to drive the stapler based on the second sheet type.

17. The post-processing device according to claim 3, wherein the controller:

obtains density of an image formed on the sheet ejected on the upper surface side of the tray; and controls the operation of the aligning unit based on the second sheet type and the density of the image.

18. The post-processing device according to claim 3, wherein the controller:

obtains environmental information that includes at least one of temperature and humidity; and controls the operation of the aligning unit based on the second sheet type and the environmental information.

19. An image forming system, comprising:

a post-processing device according to claim 1; and an image forming device that:

forms an image on a sheet; and supplies the sheet on which the image is formed to the post-processing device.

20. A controlling method applied in a post-processing device to control an operation of a post-processing unit, wherein the post-processing device comprises:

a tray that accepts a carried sheet and places thereon; and the post-processing unit that performs a post-processing to the sheet placed on the tray, and the controlling method comprises:

obtaining both of:

a first sheet type specified by a user; and a second sheet type detected by a media detector that is installed on a sheet carrying path; and controlling the operation of the post-processing unit based on the second sheet type when the first sheet type and the second sheet type are different.

21. A controlling method applied in a post-processing device to control an operation of a post-processing unit, wherein the post-processing device comprises:

a tray that accepts a carried sheet and places thereon; and the post-processing unit that performs a post-processing to the sheet placed on the tray, and the controlling method comprises:

obtaining both of:

a first sheet type specified by a user; and a second sheet type detected by a media detector that is installed on a sheet carrying path; and controlling the operation of the post-processing unit based on the second sheet type when the second sheet type is detected more in detail than the first sheet type.

22. A non-transitory recording medium storing a computer readable program to be executed by a hardware processor in a post-processing device that comprises:

a tray that accepts a carried sheet and places thereon; and the post-processing unit that performs a post-processing to the sheet placed on the tray, wherein the computer readable program causes the hardware processor executing the computer readable program to:

obtain both of:

a first sheet type specified by a user; and a second sheet type detected by a media detector that is installed on a sheet carrying path; and control the operation of the post-processing unit based on the second sheet type when the first sheet type and the second sheet type are different.

23. A non-transitory recording medium storing a computer readable program to be executed by a hardware processor in a post-processing device that comprises:

a tray that accepts a carried sheet and places thereon; and the post-processing unit that performs a post-processing to the sheet placed on the tray, wherein the computer readable program causes the hardware processor executing the computer readable program to:

obtain both of:

a first sheet type specified by a user; and a second sheet type detected by a media detector that is installed on a sheet carrying path; and control the operation of the post-processing unit based on the second sheet type when the second sheet type is detected more in detail than the first sheet type.

* * * * *